US007491024B2

(12) United States Patent
Heinrichs et al.

(10) Patent No.: US 7,491,024 B2
(45) Date of Patent: Feb. 17, 2009

(54) INTERLOCKING PALLETS, AND SHIPPING AND STORAGE SYSTEMS EMPLOYING THE SAME

(75) Inventors: Mark Anthony Heinrichs, Brielle, NJ (US); Donald Edmund Fabula, Hazlet, NJ (US); Eric Robert Boyd, Ramsey, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 459 days.

(21) Appl. No.: 11/387,082

(22) Filed: Mar. 20, 2006

(65) Prior Publication Data

US 2007/0217883 A1 Sep. 20, 2007

(51) Int. Cl.
*B60P 7/08* (2006.01)

(52) U.S. Cl. ..... 410/32; 410/33; 410/46; 410/81; 410/90; 108/53.1

(58) Field of Classification Search ..... 410/31, 410/32, 33, 34, 35, 46, 80, 81, 90, 91; 220/23.83; 108/53.1, 53.5, 56.1, 91, 92, 192; 24/287; 211/194; 248/346.02
See application file for complete search history.

(56) References Cited

U.S. PATENT DOCUMENTS

| | | | |
|---|---|---|---|
| 2,673,700 | A | 3/1954 | Eberhardt |
| 3,015,407 | A | 1/1962 | Fesmire et al. |
| 3,401,814 | A | 9/1968 | Chiswell et al. |
| 3,718,218 | A | 2/1973 | Sheilds |
| 3,782,579 | A | 1/1974 | Zarges |
| 3,797,691 | A | 3/1974 | Williams, Jr. |
| 3,857,494 | A | 12/1974 | Real |
| 3,941,271 | A | 3/1976 | Zarges et al. |
| 3,980,185 | A | 9/1976 | Cain |
| 4,062,300 | A | 12/1977 | Real |
| 4,163,495 | A | 8/1979 | Drader |
| 4,186,841 | A | 2/1980 | Buckley et al. |
| 4,287,997 | A | 9/1981 | Rolfe et al. |
| 4,344,368 | A | 8/1982 | Remington et al. |
| 4,626,155 | A | 12/1986 | Hlinsky et al. |
| 4,735,330 | A | 4/1988 | Hoss |
| 4,741,449 | A | 5/1988 | Bersani |
| 4,988,003 | A | 1/1991 | Spitzer et al. |
| 5,275,302 | A | 1/1994 | Uitz |
| 5,289,933 | A | 3/1994 | Streich et al. |
| 5,467,885 | A | 11/1995 | Blinstrub |
| 5,524,760 | A | 6/1996 | Funk |
| 5,598,787 | A | 2/1997 | Pronk |
| 5,806,701 | A | 9/1998 | Bae |
| 5,918,551 | A | 7/1999 | Liu |
| 6,250,490 | B1 | 6/2001 | Loftus |
| 6,415,938 | B1 | 7/2002 | Karpisek |
| 6,460,717 | B1 | 10/2002 | Smyers et al. |
| 6,602,032 | B2 | 8/2003 | Arai |

(Continued)

*Primary Examiner*—Stephen Gordon
(74) *Attorney, Agent, or Firm*—Frederic J. Zimmerman

(57) ABSTRACT

Shipping and storage containers, racks, and pallets including interlocking mechanisms are provided. An embodiment of the pallet includes openings, interface fittings aligned with the openings, respectively, and sized to fit into openings of identical sizes and configurations as the first and second openings, respectively, locking components operatively connected to one another, and an actuator for moving concomitantly the locking components into and out of the openings, respectively.

13 Claims, 38 Drawing Sheets

U.S. PATENT DOCUMENTS

| | | | | |
|---|---|---|---|---|
| 6,675,723 | B2 | 1/2004 | Sukeva | |
| 6,722,515 | B2 | 4/2004 | Rumpel | |
| 6,749,070 | B2 | 6/2004 | Corbett, Jr. et al. | |
| 6,811,048 | B2 | 11/2004 | Lau | |
| 6,832,580 | B2 | 12/2004 | Marchioro | |
| 6,840,378 | B2 | 1/2005 | Toguchi | |
| 6,863,180 | B2 | 3/2005 | Apps et al. | |
| 6,925,943 | B2 | 8/2005 | Salmanson et al. | |
| 7,131,803 | B2 * | 11/2006 | Guarisco et al. | 410/35 |
| 2004/0206656 | A1 | 10/2004 | Dubois et al. | |

* cited by examiner

INTERLOCKING PALLETS, AND SHIPPING AND STORAGE SYSTEMS EMPLOYING THE SAME

GOVERNMENT LICENSING CLAUSE

The invention described herein may be manufactured and used by or for the Government of the United States of America for governmental purposes without the payment of any royalties thereon or therefore.

FIELD OF THE INVENTION

The present invention relates to a pallet capable of interlocking with another pallet, a container structure, and/or a rack system. The present invention further relates to container and rack systems featuring the pallet. In particular embodiments of the invention, the pallets are typically useful for storage and transportation or goods, especially those loadable and unloadable into ISO (International Organization for Standardization) intermodal containers and flat racks and vehicles, such as, trucks and cargo bays of planes.

BACKGROUND

Pallets are widely used in the shipping industry for facilitating efficient and expeditious movement of goods (e.g., inventory, products, parts, commodities, etc.) from one place to another, and for the storage of goods prior or subsequent to shipment. Goods are placed on the platform of a pallet, which a forklift or an other mechanical device lifts off the ground. The forklift or other device is driven or manually moved for either re-locating the goods to a desired location or loading or unloading the goods on to or off of a vehicle, such as a truck, ship, or aircraft, for transportation to their intended destination.

It is often desirable to stack loaded pallets on one another to reduce storage space requirements and to optimize the storage capacity of vehicles carrying the loaded pallets. However, the stacking of a loaded pallet on the goods of another pallet can lead to undesirable problems and in some cases catastrophic results. The upper pallet and its contents can crush or otherwise damage fragile goods loaded on the lower pallet. Also, it is difficult to properly balance the loaded upper pallet on the goods of the lower pallet lacking regular size and shape, raising the risk that the upper pallet and its load may topple over, placing individuals in proximity to the stack in grave danger of bodily injury, and risking damage to nearby property. Vibrations and load shifting encountered during shipping and forklift transfer of loaded pallets can increase the risk of goods and pallets near the top of a stack dislodging and falling to the ground.

One solution to overcome the above problems is to transfer the goods from the pallet platform to a rack or into the compartment of a shipping container. The walls of a shipping container confine the movement of the goods to the container compartment during shipment. Further, the walls of a rack or shipping container also bear the weight of other goods, racks and containers stacked thereon, removing the weight-bearing load from the goods themselves. As a consequence, goods possessing fragility or irregular sizes and shapes can be securely stored in racks or transported in shipping containers without the above-described drawbacks of pallets.

But transferring goods from a pallet to a rack or shipping container or between rack and shipping container is a time-consuming and laborious task, especially if the nature of the goods requires their individual transfer, for example, to protect against damage due to their fragility or because of extreme bulkiness or large mass that prevents the simultaneous transfer of multiple goods. Further, once the loaded containers arrive at their intended destination, oftentimes the goods must be unloaded from the container to an open storage structure, such as, a pallet or rack, which favors accessibility of the goods. The open structure of a storage rack, for example, allows potential customers to easily view and select goods for purchase without the inconvenience of lifting a container lid. In a warehouse, open racks permit workers to more easily access inventory for sale, packaging, and shipment.

Another common solution for overcoming the aforementioned problems of accidental toppling of a stack of containers or racks is to use mechanical fasteners, such as ties and straps for holding stacked containers or racks to one another. Application of conventional mechanical fasteners is time-consuming and laborious, often requiring the application of multiple fasteners to properly secure the stack. This conventional solution also requires that the shipper keep a stock of ties, straps, and mechanical fasteners, and continuously replenish their stock before it is exhausted. These inefficiencies serve to increase expenses and to complicate shipping and storage protocols. Further, the person responsible for securing the stacked containers and racks together may be placed in a vulnerable position, thereby partly defeating the purpose for strapping in the first place.

Another problem associated with the use of pallets is that after the goods have been off-loaded, the pallets oftentimes are needed for reuse at their original point of departure or elsewhere. Stacking off-loaded pallets on one another for transportation is much more efficient than moving the pallets individually, one at a time. However, as described above, various forces and hazards are encountered in the raising, lowering, and shipment of stacked pallets that can cause the stack to topple over. While the use of ties or straps can overcome these problems, application and removal of mechanical fasteners is time-consuming and laborious.

SUMMARY OF THE INVENTION

It is an aspect of the invention to provide pallets capable of interlocking with one another in a convenient and efficient manner, and to provide methods of making and using the interlocking pallets.

Yet another aspect of the invention provides a plurality of stackable, inter-lockable pallets, including at least first and second pallets. The first pallet features first and second interface fittings. The second pallet features first and second locking components operatively connected to one another, and an actuator for moving concomitantly the first and second locking components into and out of engagement with the first and second interface fittings, respectively, for selectively interlocking the pallets to one another.

Yet another aspect of the invention is directed to stackable, inter-lockable first and second pallets. The first pallet features a first pallet frame including first and second openings, a first pallet platform supported by the first pallet frame, first and second interface fittings, first and second locking components operatively connected to one another, and a first actuator for moving concomitantly the first and second locking components into and out of the first and second openings, respectively. The second pallet is stackable on the first pallet, and features a second pallet frame including third and fourth openings positioned for receiving the first and second interface fittings, respectively, a second pallet platform supported by the second pallet frame, third and fourth interface fittings, third and fourth locking components operatively connected to one another, and a second actuator for moving concomitantly the third and fourth locking components into and out of the third and fourth openings. When the second pallet is stacked on the first pallet, the concomitant movement causes the third and fourth locking components to move into and out of engagement with the first and second interface fittings, respectively, for selectively interlocking the first and second pallets to one another.

Yet a further aspect of the invention is directed to stackable, inter-lockable first and second pallets. The first pallet features a first pallet frame including first, second, third, and fourth openings; a first pallet platform supported by the first pallet frame; first, second, third, and fourth interface fittings, respectively; first and second locking components operatively connected to one another; a first actuator for moving concomitantly the first and second locking components into and out of the first and second openings, respectively; third and fourth locking components operatively connected to one another; and a second actuator moving concomitantly the third and fourth locking components into and out of the third and fourth openings, respectively. The second pallet is stackable on the first pallet, and features a second pallet frame including fifth, sixth, seventh, and eighth openings positioned for receiving the first, second, third, and fourth interface fittings, respectively, when the second pallet is stacked on the first pallet; a second pallet platform supported by the second pallet frame; fifth, sixth, seventh, and eighth interface fittings; fifth and sixth locking components operatively connected to one another; a third actuator for moving concomitantly the fifth and sixth locking components into and out of the fifth and sixth openings and, when the second pallet is stacked on the first pallet, for permitting concomitant movement of the fifth and sixth locking components into and out of engagement with the first and second interface fittings, respectively, for selectively interlocking the first and second pallets to one another; seventh and eighth locking components operatively connected to one another; and a fourth actuator for moving concomitantly the seventh and eighth locking components into and out of the seventh and eighth openings and, when the second pallet is stacked on the first pallet, for further permitting concomitant movement of the seventh and eighth locking components into and out of engagement with the third and fourth interface fittings, respectively, for selectively interlocking the first and second pallets to one another.

Yet another aspect of the invention provides a pallet featuring first and second openings, first and second interface fittings aligned with the first and second openings, respectively, first and second locking components, and an actuator. The first and second interface fittings are sized to fit into openings of identical sizes and configurations as the first and second openings, respectively. The first and second locking components are operatively connected to one another to permit their concomitant movement into and out of the first and second openings, respectively.

Yet still another aspect of the invention to provide storage assemblies capable of interlocking with one another in a convenient and efficient manner, and to provide methods of making and using the interlocking storage assemblies.

Yet a further aspect of the invention is directed to a plurality of stackable, inter-lockable storage assemblies. A first storage assembly features a first pallet, first and second structural support members extending above the first pallet, and first and second interface fittings on the first and second structural support members, respectively. A second storage assembly features a second pallet, first and second locking components operatively connected to one another, and an actuator for moving concomitantly the first and second locking components into and out of engagement with the first and second interface fittings, respectively, for selectively interlocking the first and second storage assemblies to one another.

Yet another aspect of the invention provides a storage assembly including a pallet, first and second structural support members extending above the pallet, first and second interface fittings on the first and second structural support members, respectively, first and second locking components, and an actuator. The pallet includes first and second openings. The first and second interface fittings are sized to fit into openings of identical sizes and configurations as the first and second openings, respectively. The first and second locking components are operatively connected to one another. The actuator permits concomitant movement of the first and second locking components into and out of the first and second openings, respectively.

Other aspects of the invention relate to the making and use of stackable pallets and shipping and storage systems described herein. (HERE)

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings:

FIGS. 16A and 16B are perspective front views of the collapsible container with the front panel removed;

DETAILED DESCRIPTION OF EMBODIMENTS AND METHODS OF THE INVENTION

Figure 1:
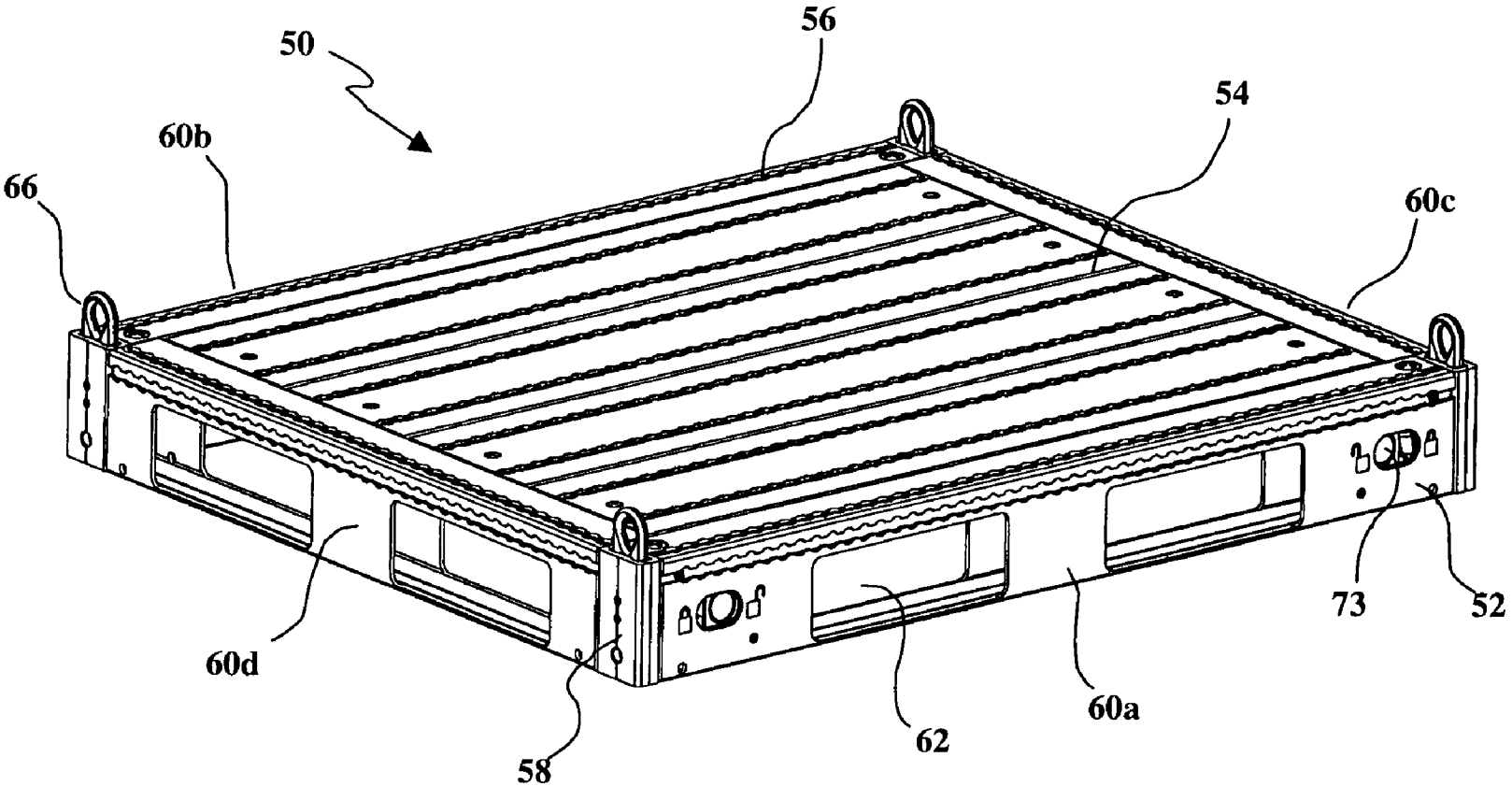
FIG. 1 is a perspective view of a pallet according to a first embodiment of the invention.

Reference will now be made in detail to the present embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

The terms "left," "right," "front," "rear," "horizontal," "vertical," and the like are used herein to assist in and facilitate the description of the invention. For the purposes of the detailed description, the reference for each of these terms is the arrangement and orientation of the pallet as it is depicted in FIG. 1, in which the pallet platform is horizontally oriented and the front frame member faces forward. The ability to move and rotate the pallet into other orientations and positions makes the designations of these terms to the various parts of the pallet dependent upon view of reference. Accordingly, it should be understood that these terms are not to be considered limitations of the invention as the invention is defined in the claims and by equivalents of the claims, unless the context clearly dictates otherwise.

A pallet according to a first embodiment of the invention is shown in FIG. 1, where the pallet is generally designated by reference numeral 50. Pallet 50 features a pallet frame 52 supporting a pallet platform 54. Pallet frame 52 is quadrilateral, and more particularly rectangular or square. Pallet frame 52 includes four vertical corner posts 58 joined to one another with four elongate beams 60*a*-60*d* defining the outer edges of pallet frame 52. In FIG. 1, each beam 60*a*-60*d* includes side-by-side entryway openings 62 sized and positioned for receiving a forklift truck tines and pallet jack forks from either side or either end of pallet 50. It should be understood that four-way entry pallet frame 52 embodied in the figures may be replaced with a one-way, two-way, or three-way forklift entry design. Optionally, the forklift-entry features may be omitted entirely. Pallet frame 52 and pallet platform 54 may be made of the same or different materials, such as, for example, wood, metal, composite, or other suitable materials.

Pallet platform 54 has substantially flat upper and lower surfaces, and may include, for example, a solid integral sheet or a plurality of parallel planks extending to and bounded by pallet frame 52. Alternatively, pallet platform 54 may comprise a mesh, grating or the like. Optionally, the upper surface of pallet platform 54 includes multiple integrated tie-down tracks 56.

Figure 2:
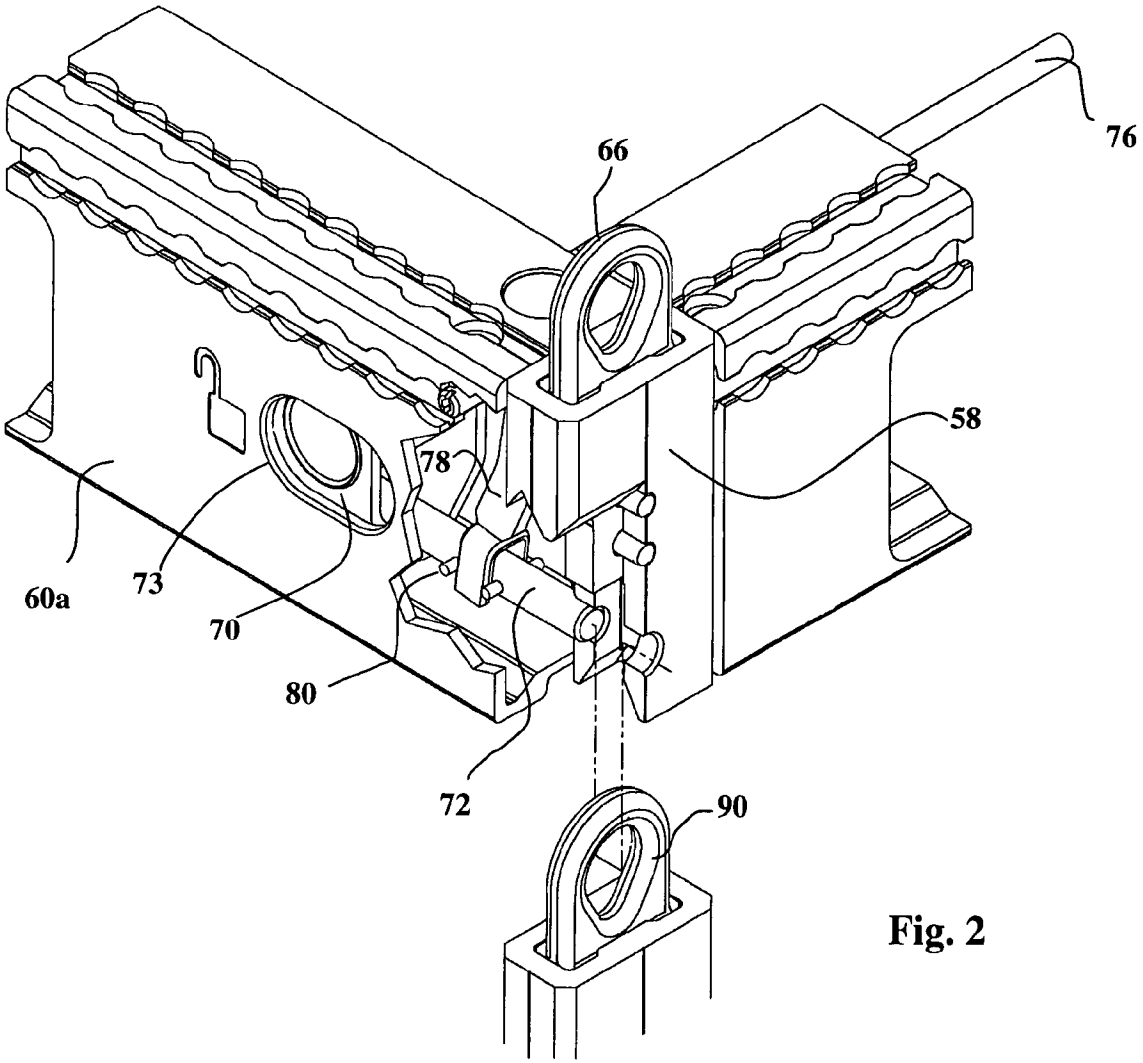
FIG. 2 is an enlarged, partially cut-away view of the pallet of FIG. 1 to expose a locking mechanism in relationship to interface fittings.
Figure 4:
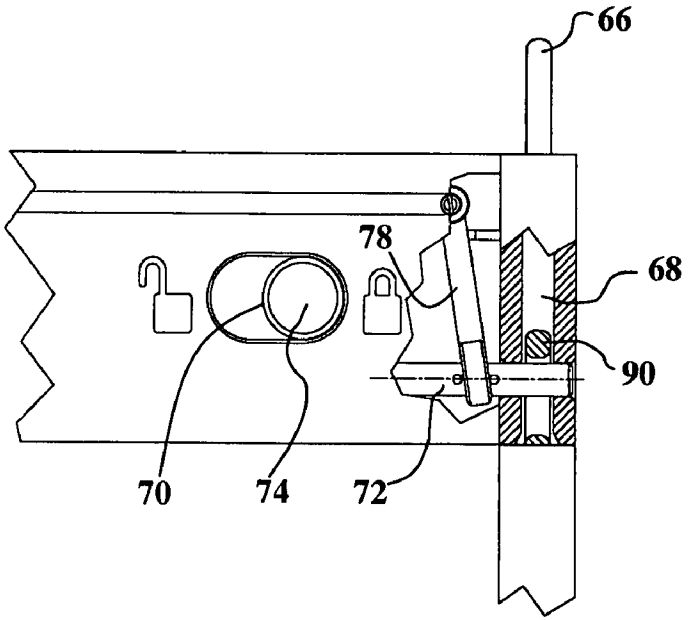
FIG. 4 is a side sectional view similar to FIG. 3, but depicting the locking mechanism in locking arrangement and engaged with the interface fitting.
Figure 3:
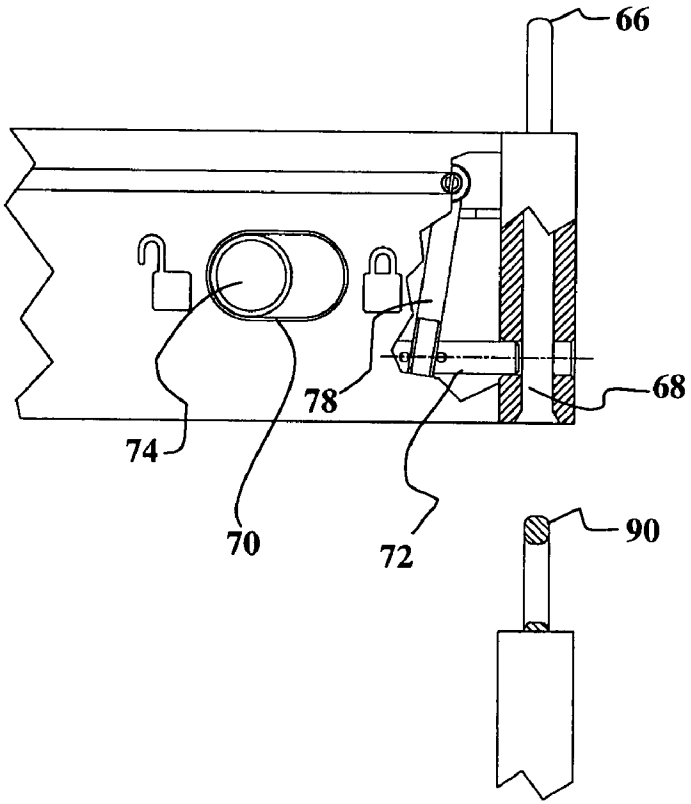
FIG. 3 is a partially cut-away, partially sectional side view of the pallet of FIG. 1, depicting the locking mechanism out of locking arrangement and disengaged from the interface fitting.

The locking mechanisms of pallet 50 according to an embodiment of the invention will now be described in greater detail with reference to FIGS. 2-4. Each corner post 58 is embedded with, integrally formed with, or otherwise securely joined to a respective interface fitting 66 extending above the top surface of post 58. Interface fitting 66 defines an eyelet opening exposed above post 58. Each corner post 58 possesses a cavity 68 immediately below interface fitting 66, and a bottom opening for accessing cavity 68.

Locking mechanisms are integrated in opposite ends of front beam (as viewed in FIG. 1) 60*a*. The locking mechanism on the right side of front beam 60*a* (as shown in FIG. 1) is depicted in greater detail in FIGS. 2-4. The locking mechanism includes a lock slider 70 slidably housed in a channel of front beam 60*a*. Lock slider 70 is fixedly joined to a cylindrical locking bolt 72 also housed in front beam 60*a*. An outward-facing access opening 73 in beam 60*a* exposes a keyhole 74 of lock slider 70 for accessing and actuating the locking mechanism. A key (not shown) is insertable into keyhole 74 for translating lock slider 70 back and forth along the end portion of front beam 60*a*. Alternatively, keyhole 74 may include a graspable recess that is hand or finger operated without use of a key. Translational movement of lock slider 70 causes joined cylindrical locking bolt 72 to move in tandem with lock slider 70 axially into and out of corner post cavity 68. It should be understood that the locking mechanism on the left side of front beam 60*a*, while not described in the interest of brevity, is the substantial mirror image of the locking mechanism on the right side of front beam 60*a*.

Although not shown, rear beam 60*b* has substantially identical rear locking mechanisms including locking bolts axially movable into and out of corner post cavities of the right and left rear corner posts, respectively. Optionally, additional keyholes are provided in rear beam 60*b* for permitting actuation of the rear locking mechanisms from the far side of pallet 50.

The locking mechanisms of front and rear beam 60*a*, 60*b* are operatively connected to one another to permit their concomitant movement via actuation of keyhole 74 of either the front or rear beam 60*a*, 60*b*. Operative connection between the locking mechanisms is accomplished using a coupling shaft 76 and devises 78, which establish a pivot joint. A first coupling shaft 76 is housed in or positioned along far side beam 60*c*. Bearings and the like may be used to facilitate rotation of shaft 76 about its longitudinal axis. Each end of first coupling shaft 76 is joined to an upper end of a respective clevis 78, whereby rotational movement of shaft 76 pivots devises 78 about their upper ends. Clevis pins 80 received in oblong slots of devises 78 secure the opposite lower ends of devises 78 to locking bolts 72. Rotational movement of first coupling shaft 76 concomitantly pivots devises 78 and linearly slides locking bolts 72 at the opposite ends of beam 60*b* into and out of corner post cavities 68, where bolts 72 lockingly engage interface fittings of another pallet, storage structure, and related structures.

It should be understood that substantially identical locking mechanisms are situated in front left and rear left corner posts 58. A second coupling shaft and a second set of devises housed in or adjacent near side beam 60*d* cooperate with the second coupling shaft for permitting concomitant movement of the locking mechanisms at the opposite ends of beam 60*d* into and out of locking arrangements.

In operation, pallet 50 is rested or stacked on a structure (e.g., another pallet, container, rack system, trailer deck, etc., as described in greater detail below) having interface fittings substantially identical to interface fittings 66. In FIGS. 2-4, the separate, substantially identical interface fittings of the other structure are designated by reference numeral 90. Interface fittings 90 are sized and arranged to be received through the bottom openings of corner post cavities 68 so that eyelets of interface fittings 90 align axially with locking bolts 72. A key or other actuator is inserted through the outward-facing access opening 73 of front beam 60*a* (or rear beam 60*b*) into keyhole 74. Lock slider 70 is manually translated, i.e., slid, from an unlocked position to a locked position so that locking bolt 72 attached to lock slider 70 travels linearly into corner post cavity 68 to engage the eyelet of interface fitting 90. The translational movement of lock slider 70 and locking bolt 72 causes clevis 78 to pivot about coupling shaft 76, thereby causing attached coupling shaft 76 to rotate synchronously about its longitudinal axis. The rotational movement of coupling shaft 76 pivots clevis 78 at the opposite end of coupling shaft 76, moving locking bolt 72 at the opposite end of rear beam 60*b* into its respective rear corner post cavity 68. As two locking bolts 72 are attached to opposite ends of a common coupling shaft 76, devises 78 and locking bolts 72 move in unison with one another into locking engagement with interface fittings 90. To move locking bolts 72 out of locking engagement, the lock slider 70 is slid in the opposite direction to rotate shaft 76 axially back to its original position.

The locking mechanisms at the opposite ends of beam 60*d* operate in substantially the same manner, moving concomitantly into and out of locking arrangements to engage and disengage respective interface fittings. It should be understood that the locking mechanisms at each corner of pallet 50 may be operatively connected to one another so that all move in unison, e.g., by employing constructions similar to those described below.

Pallet 50 may be stacked on or under an additional one or a plurality (e.g., two, three, or more) pallets having substantially identical interface fittings and selectively interlocked together. For example, a lower first pallet may serve as a support for stacking of an upper second pallet thereon. Interface fittings 90 of the lower first pallet are received in counterpart corner post cavities 68 of the upper second pallet. One or both sets of the locking mechanisms of the upper second pallet are selectively actuated to move locking bolts 72 of the upper second pallet into and out of engagement with interface fittings 90 of the lower first pallet. Since the locking mechanisms of the illustrated embodiment are operatively connected together in pairs, secure interlocking of locking mechanisms on opposite sides of the pallet only requires access to either front beam 60*a* or rear beam 60*b*.

Figure 5:
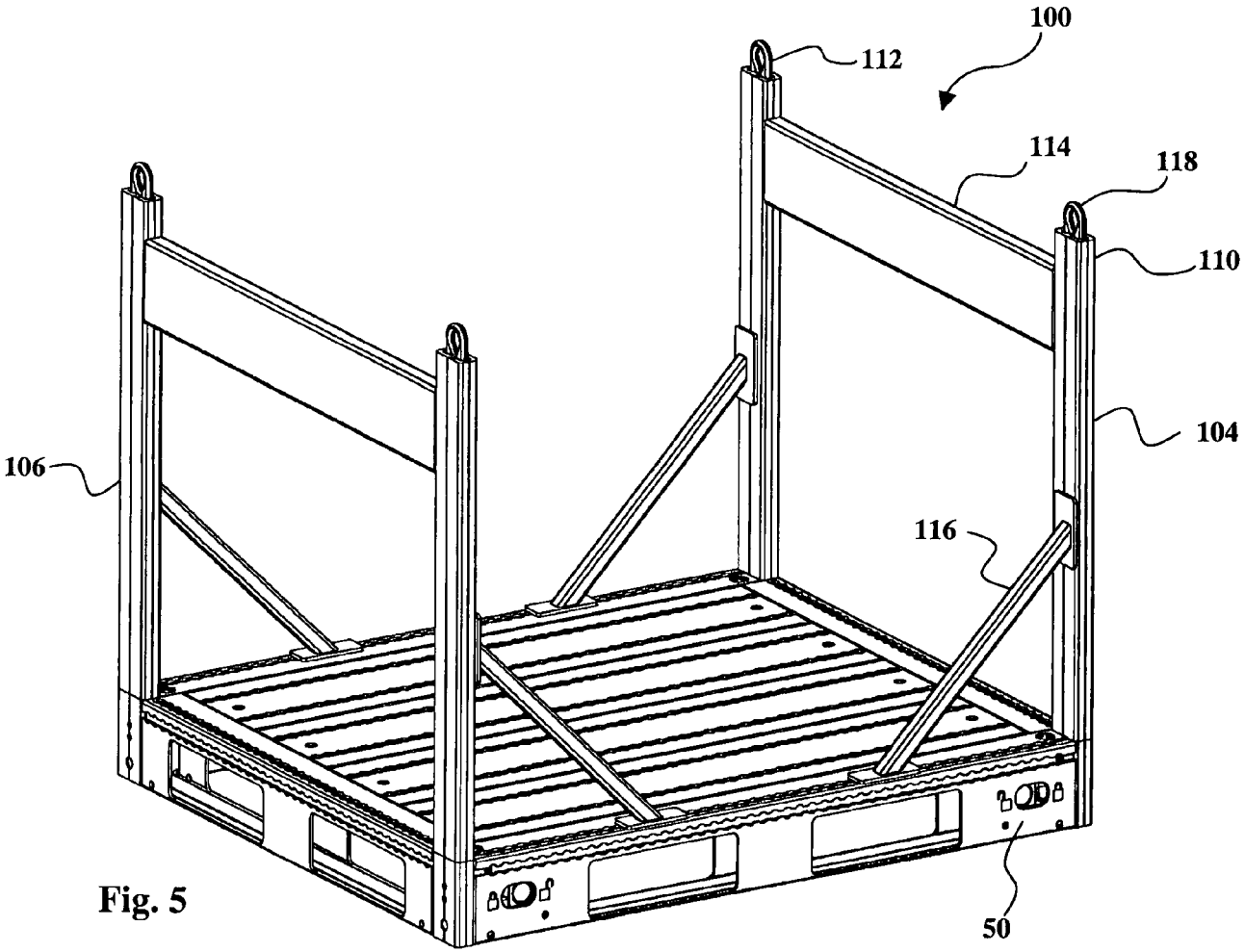
FIG. 5 is a perspective view of a rack storage system according to an embodiment of the invention.

Pallet 50 is particularly useful as the support base of shipping and storage systems. FIG. 5 illustrates a storage rack 100 according to another embodiment of the invention. Storage rack 100 includes pallet 50 sometimes described as a base pallet or a lower first pallet. First and second frame members 104 and 106 are arranged on opposite sides of base pallet 50 to face one another. Frame member 104 has a pair of vertical stacking posts 110, 112 joined together with cross member 114. Diagonal braces 116 extend from stacking posts 110, 112 to the upper surface of pallet 50 to provide structural support for rack member 104. An interface fitting 118 is provided at the upper end of each stacking post 110, 112. Interface fittings 118 generally are identical in size and shape to interface fittings 66 of pallet 50. The lower ends of stacking posts 110, 112 include openings and cavities sized to receive interface fittings 66 of lower first pallet 50. Apertures or bolt throughholes are provided proximal to the lower ends of each of stacking posts 110, 112 and are positioned to align with the eyelet openings of interface fittings 66. A locking pin or bolt (not shown) is slid through the apertures or bolt throughholes and the aligned eyelet openings of interface fittings 66 for securing frame member 104 to lower first pallet 50. Frame member 106 is substantially identical to and includes each of the above features of frame member 104.

Storage rack 100 optionally further comprises an upper second pallet (not shown) that is identical to pallet 50. The upper second pallet rests on posts 110, 112 of frame members 104, 106 directly over and in substantially parallel relationship to lower first pallet 50. Openings and associated cavities 68 in the bottom of the upper second pallet receive interface fittings 118 of posts 110, 112 from below. The upper second pallet features locking mechanisms substantially identical to those locking mechanisms of pallet 50 for selectively engaging and disengaging interface fittings 118 of frame members 104, 106.

Figure 6:
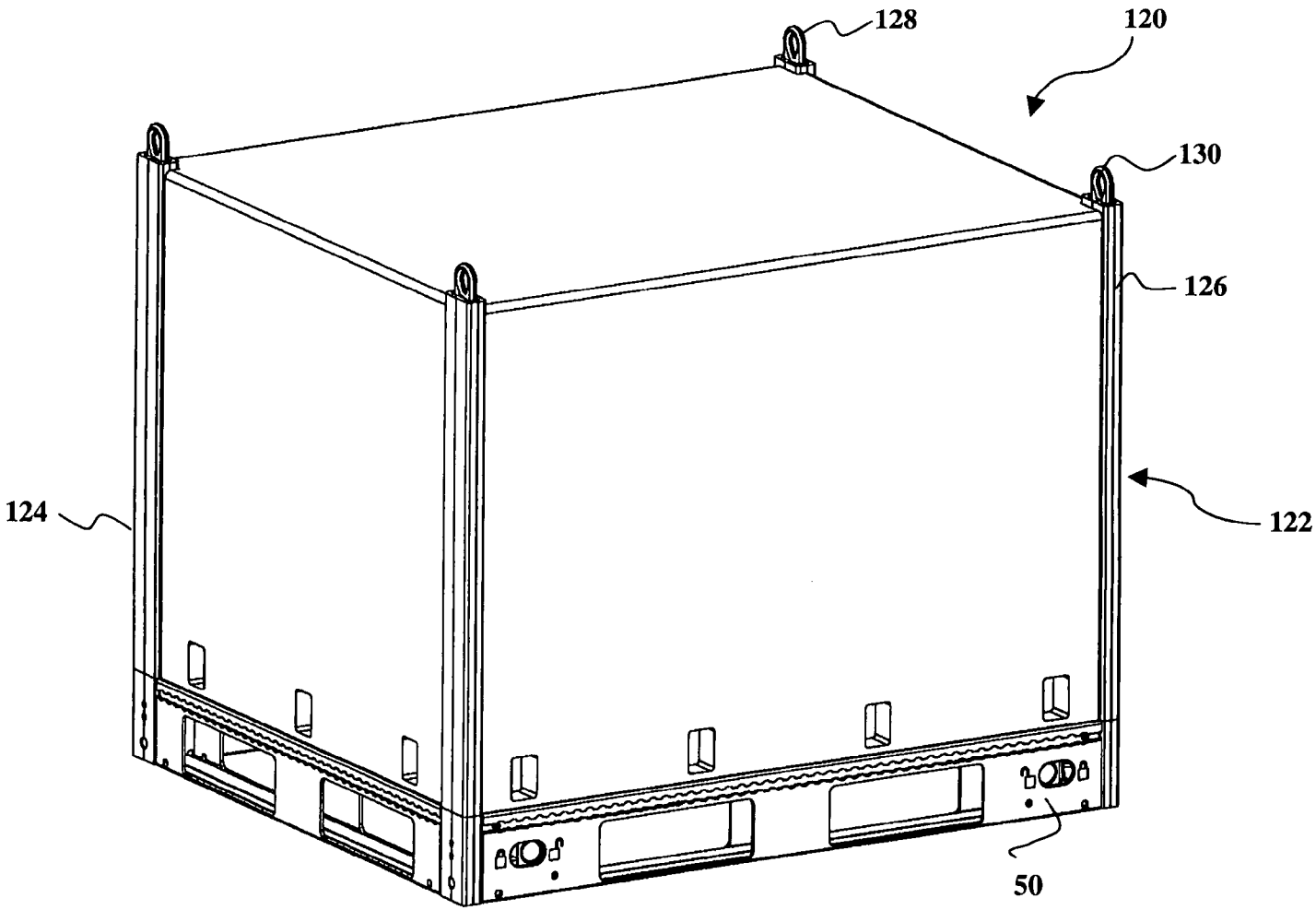
FIG. 6 is a perspective view of a container storage system according to another embodiment of the invention.

FIG. 6 illustrates a storage and shipping container 120 according to another embodiment of the invention. Container 120 includes pallet 50 as a lower first pallet, and opposite side panels 122, 124 facing and spaced apart from one another on opposite sides of pallet 50. Front and rear panels (unnumbered) extend between side panels 122, 124, and a top panel or lid rests thereon to establish a compartment. Side panel 122 is integrally connected to posts 126, 128 at its opposite sides. Interface fittings 130 are provided at the upper end of stacking posts 126, 128. Interface fittings 130 generally are identical in size and shape to interface fittings 66 of pallet 50. The lower ends of stacking posts 126, 128 include openings and cavities similar to cavity 68 sized to receive respective interface fittings 66 of lower first pallet 50. Apertures or bolt throughholes are provided proximal to the lower ends of each of stacking posts 126, 128 and are positioned to align with the eyelet openings of interface fittings 66. A locking pin or bolt (not shown) is inserted into the apertures or bolt throughholes and the aligned eyelet openings of interface fittings 66 for securing side panel 122 to lower first pallet 50. Side panel 124 is substantially identical to and includes each of the above features of side panel 122.

Optionally, another storage container having a second pallet which is substantially identical to pallet 50 may be stacked on container 120. Openings and associated cavities 68 in the bottom of the upper second pallet receive interface fittings 130 from below. The upper second pallet features locking mechanisms substantially identical to those locking mechanisms of pallet 50 for selectively engaging and disengaging interface fittings 130 of panels 122, 124.

An automatic locking pallet according to another embodiment of the invention will now be described in detail with reference to FIGS. 7-12. Generally, the pallet includes a pallet frame having a forklift tine opening, a pallet platform supported by the pallet frame, a locking component movable into and out of a locking arrangement for respectively engaging and disengaging an interface fitting of another pallet when the automatically locking pallet and the other pallet are stacked, and an actuator operatively connected to the locking component, and constructed and arranged for activation by a forklift tine entering the forklift tine opening to move the operatively connected locking component out of the locking arrangement.

Figure 7:
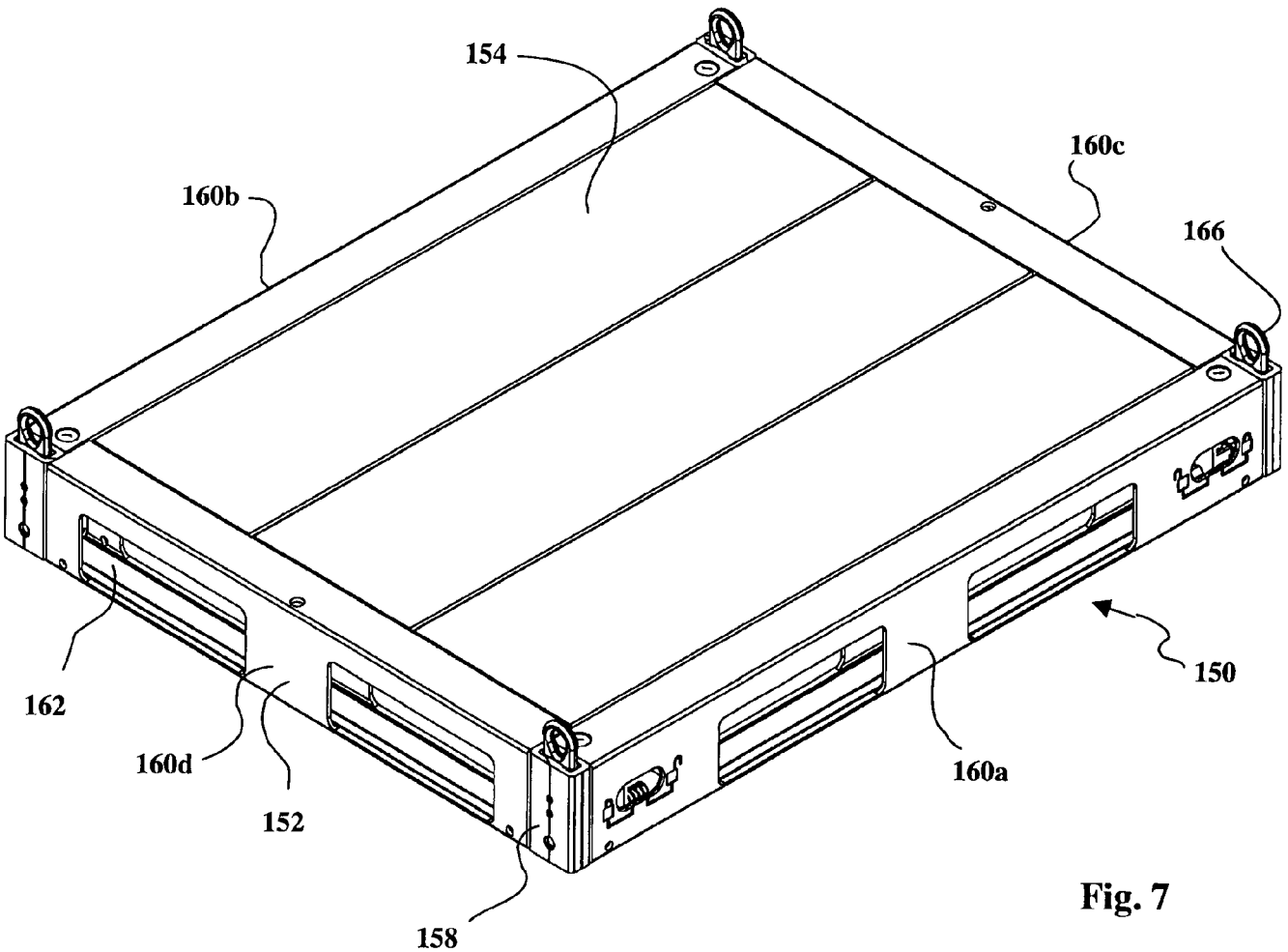
FIGS. 7 and 8 respectively are top and bottom perspective views of a pallet incorporating an automatic locking mechanism according to another embodiment of the invention.
Figure 8:
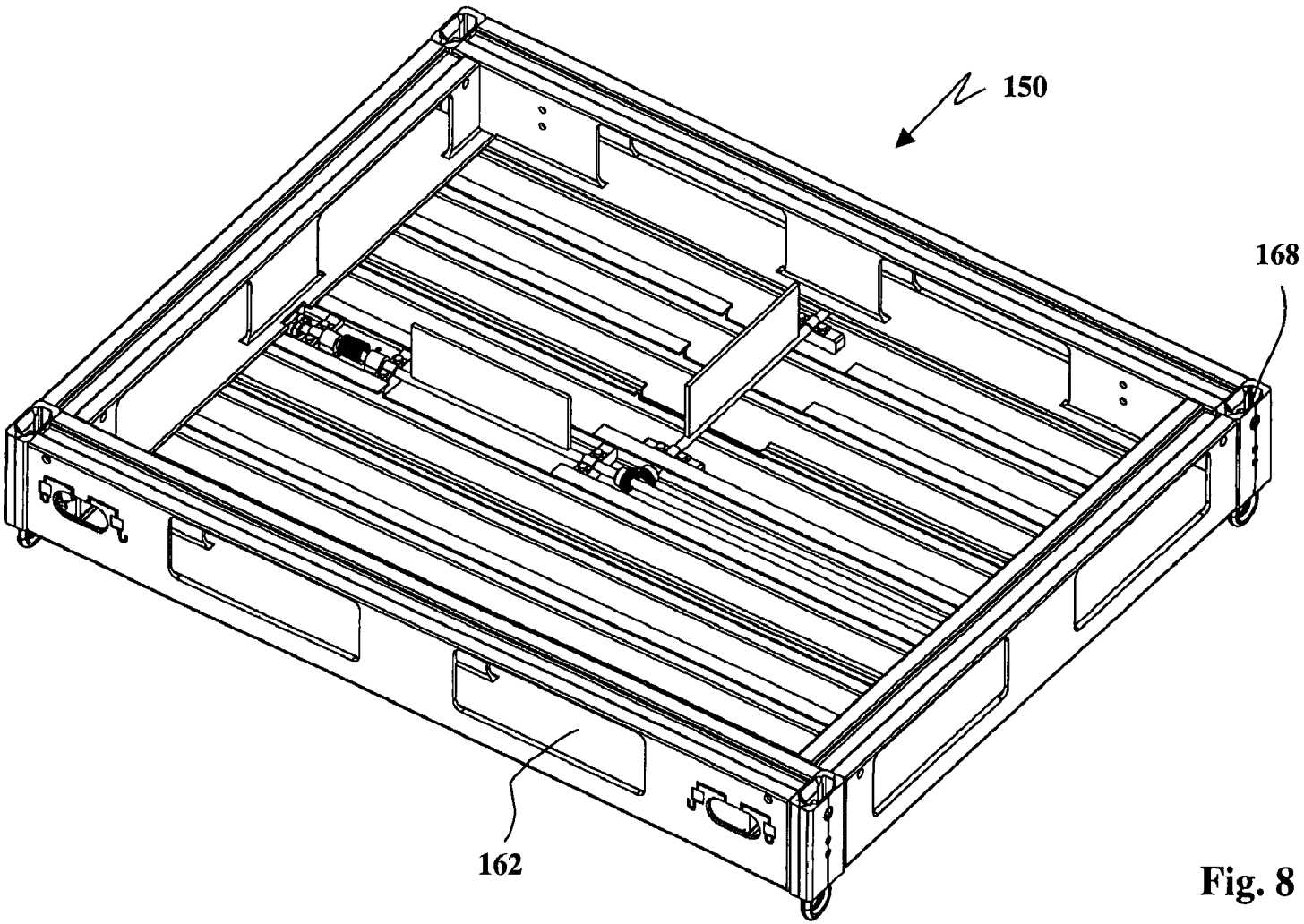

Pallet 150 features pallet frame 152 supporting pallet platform 154. Vertical corner posts 158 of pallet frame 152 are joined to one another with four elongate beams 160*a*-160*d* defining the outer edges of pallet frame 152. The vertical corner posts may be hollow, solid or some other construction. Beams 160*a*-160*d* include side-by-side entryway openings 162 sized and positioned for receiving forklift truck tines and pallet jack forks from either side or either end of pallet 150. The side-by-side entryway openings 162 of each beam 160*a*-160*d* are either perpendicular or parallel to the other side-by-side entryway openings 162 in the other beams 160*a*-160*d*, as seen in FIG. 7. The four-way entry pallet frame 152 embodied in the figures may be replaced with a one-way, two-way, three-way, or more forklift entry design. Pallet frame 152 and pallet platform 154 may be made of the same or different materials, such as, for example, wood, metal, composite, or other suitable materials.

An interface fitting 166 is embedded in, integrally formed with, or otherwise joined to and extends above each corner post 158. Each interface fitting 166 defines an eyelet opening. The lower end of each corner post 158 includes an opening leading to a cavity 168 aligned below the interface fitting 166.

Figure 9:
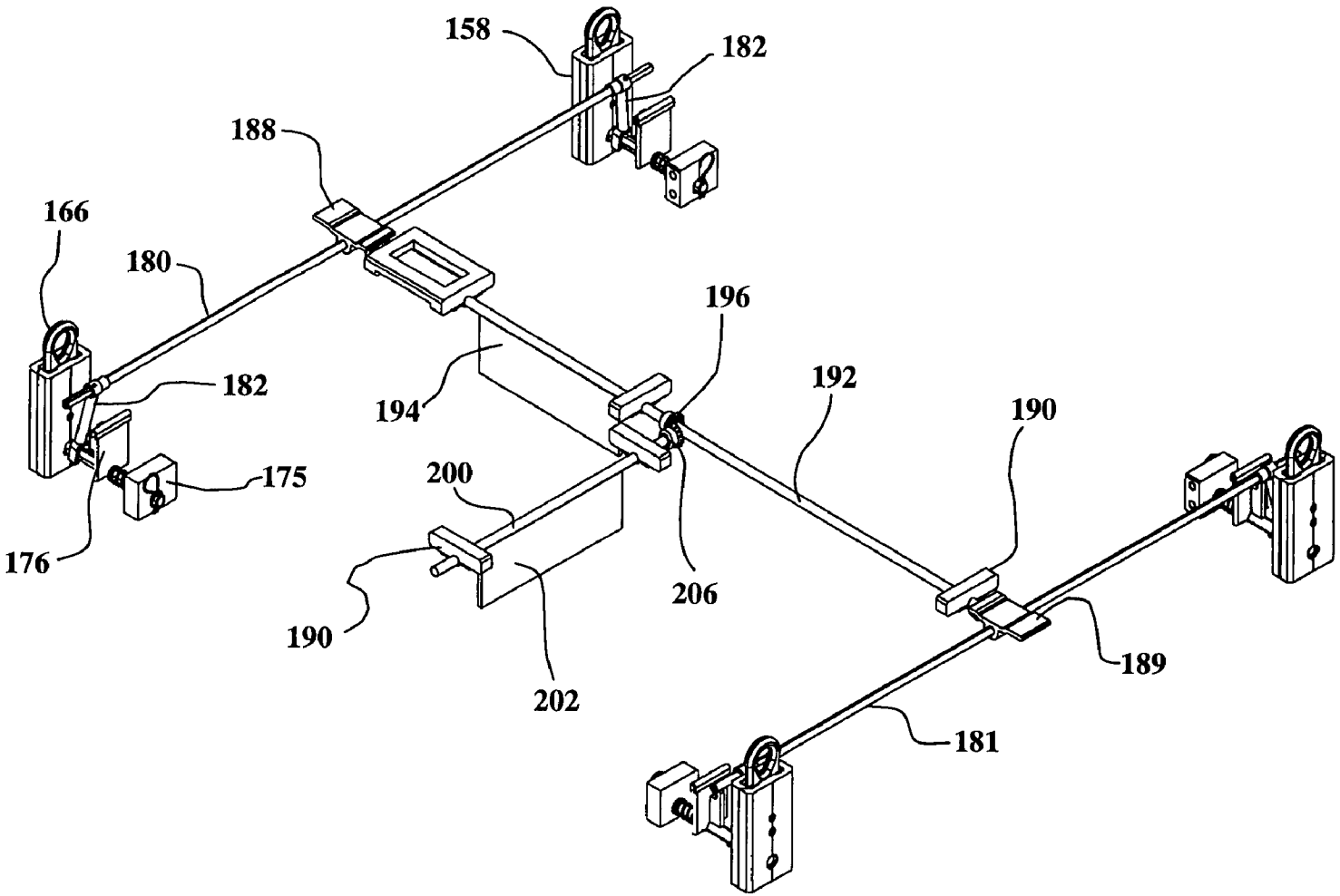
FIG. 9 is a perspective, isolated view of the automatic locking mechanism of the pallet of FIGS. 7 and 8, in a non-actuated mode.
Figure 10:
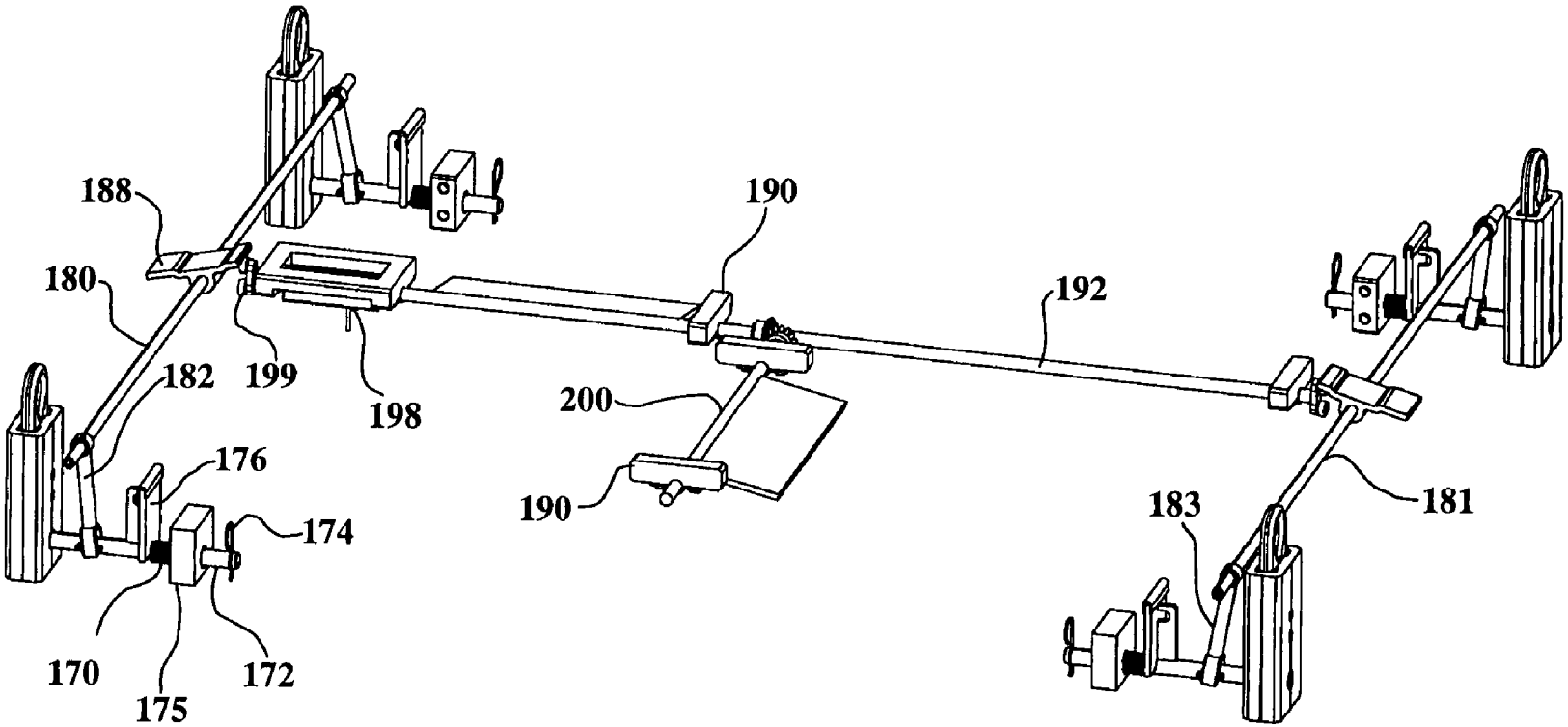
FIG. 10 is a perspective, isolated view of the automatic locking mechanism of FIG. 9 in an actuated mode.
Figure 11:
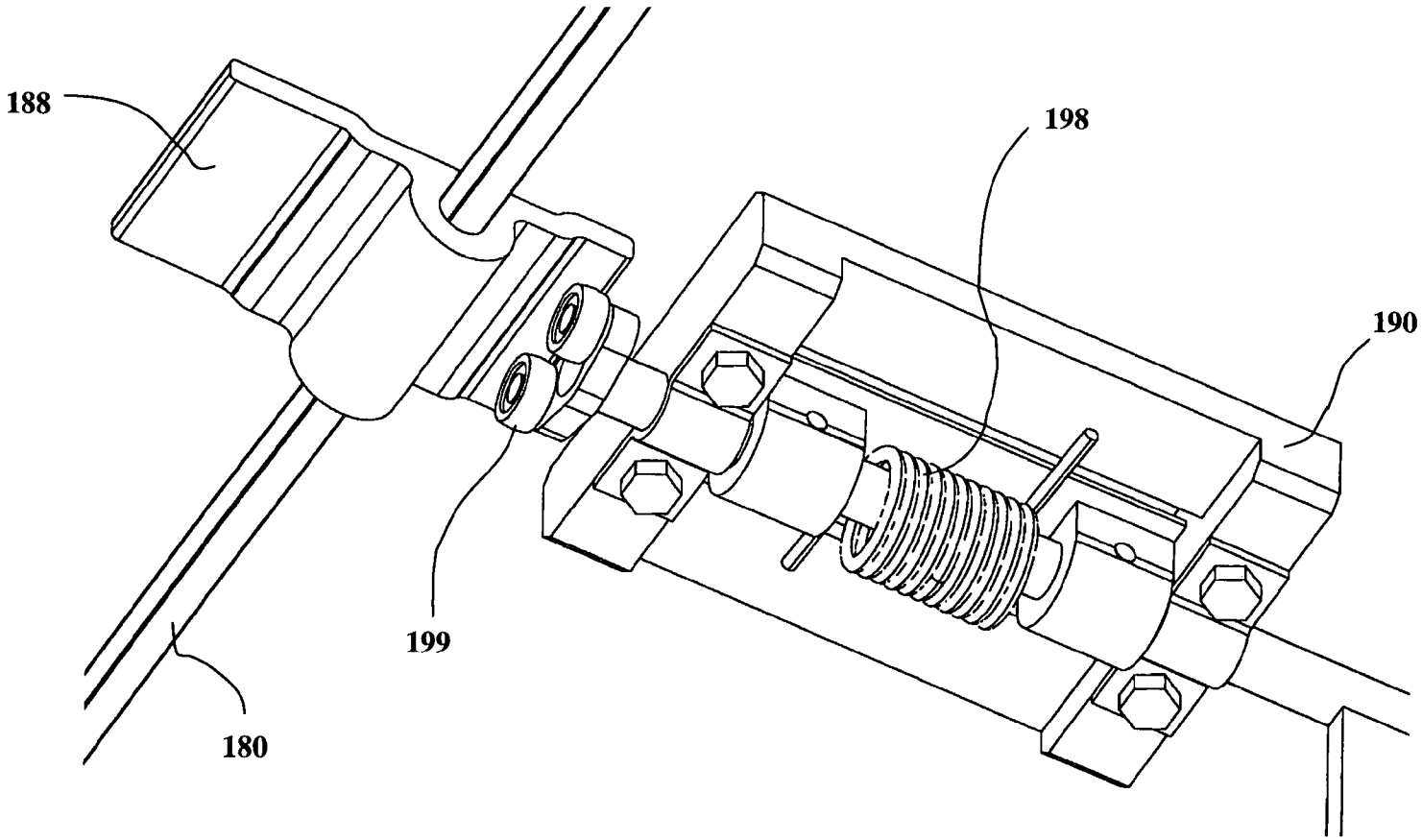
FIG. 11 is an enlarged, perspective bottom view of a rocker arm assembly of the automatic locking mechanism of FIGS. 9 and 10.
Figure 12:
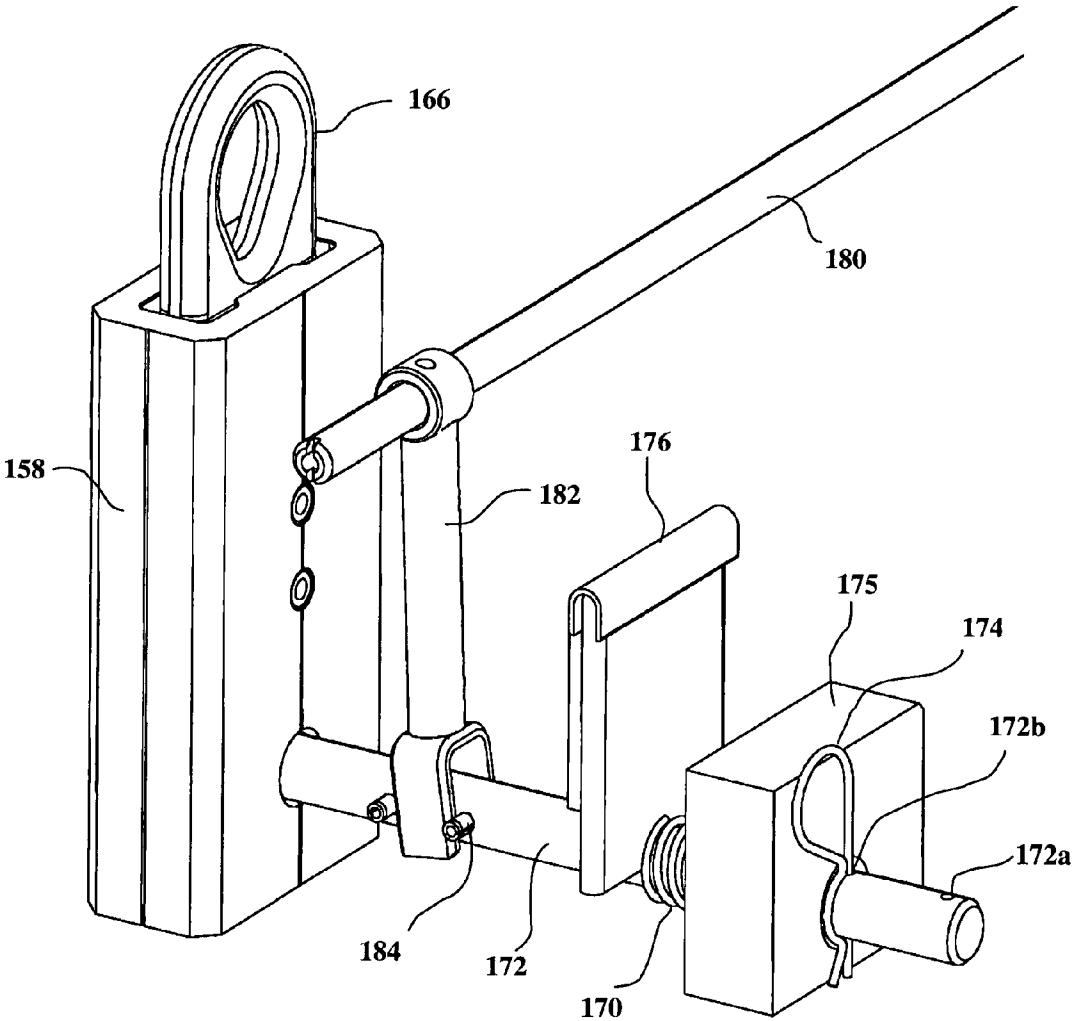
FIG. 12 is an enlarged, perspective view of a locking component assembly of the automatic locking mechanism of FIGS. 9 and 10, showing mechanism for manual override.

The opposite ends of front and rear beams 160*a*, 160*b* each house a respective pair of locking mechanisms. As shown in FIG. 12, each locking mechanism includes a cylindrical locking bolt 172 including first and second holes 172*a*, 172*b*. First hole 172*a* is closer to the distal end of locking bolt 172 than second hole 172*b*. Hairpin 174 is depicted in FIGS. 9-11 as inserted in first hole 172*a*, and in FIG. 12 as inserted in second hole 172*b*. As will become evident from the description below, insertion of hairpin 174 in first hole 172*a* places the locking mechanism in automatic locking mode, whereas insertion of hairpin 174 in second hole 172*b* retains the locking mechanism in non-locking mode, effectively overriding the automatic locking function of the mechanism.

A spring 170 is fitted over locking bolt 172 and compressed between stationary block 175 fixedly joined to the bottom surface of pallet platform 154 and a slidable plate 176 fixedly joined to locking bolt 172. Spring 170 urges plate 176 and locking bolt 172 towards corner post 158. The proximal end portion of locking bolt 172 is sized to fit within an aperture of corner post 158, so that locking bolt 172 may penetrate into corner post cavity 168 where bolt 172 may interlock with an interface fitting of another pallet, rack post, container wall, or similar structure received in opening 168.

The locking mechanisms positioned at opposite ends of right side beam 160*c* are operatively connected to one another to permit their concomitant movement into and out of locking arrangements. Operative connection between the locking mechanisms is accomplished using a first coupling shaft 180 and devises 182. First coupling shaft 180 is housed in or adjacent side beam 160*c*. Bearings and the like may be used to facilitate rotation of first coupling shaft 180 about its longitudinal axis. A first rocker arm 188 is fixed at the midpoint of first coupling shaft 180. Rocker arm 188 has symmetrical inner and outer wings. Each end of first coupling shaft 180 is joined to an upper end of a respective clevis 182. Clevis pins 184 secure the lower ends of devises 182 to locking bolts 172. Rotational movement of first coupling shaft 180 pivots devises 182 about their upper ends, thereby concomitantly moving locking bolts 172 at the opposite ends of beam 160*c* into and out of locking arrangements. In an alternate embodiment, the rocker arm 188 need not be symmetric and thus only require one wing for operation though additional wings may be added for optional modes of operating the locking mechanism and can be oriented accordingly.

Substantially identical locking mechanisms are situated in left front and rear corner posts 158, i.e., at the opposite ends of beam 160*d*. A second coupling shaft 181 and a second set of devises 183 housed in or adjacent side beam 160*d* permit concomitant movement of the locking mechanisms at the opposite ends of beam 160*d* into locking arrangements and out of locking arrangements. A second rocker arm 189 is fixed at the midpoint of second coupling shaft 181. First and second coupling shafts 180, 181 and devises 182, 183 are operatively connected to one another and to actuators 194, 202, also referenced to as a primary actuator paddle 194 and a secondary actuator paddle 202, as follows.

Brackets 190 mount a primary actuator shaft 192 and a secondary actuator shaft 200 to the bottom surface of pallet platform 154. A primary actuator paddle 194 and a secondary actuator paddle 202 extend radially downward from primary actuator shaft 192 and second actuator shaft 200, respectively. Primary actuator paddle 194 is aligned with forklift tine openings of beams 160*a* and 160*b*. Secondary actuator paddle 202 is perpendicular to primary actuator paddle 194, and is aligned with forklift tine openings of beams 160*c* and 106*d*. Miter gears 196, 206 mounted on actuator shafts 192, 200 intermesh to cause shafts 192, 200 to rotate axially in unison with one another.

Torsion spring 198 is fitted on and attached to primary actuator shaft 192. Torsion spring 198 imparts a biasing force that urges primary actuator shaft 192 into a rotational position in which primary and secondary actuator paddles 194, 202 face downward. Torsion spring 198 retains primary and secondary actuator paddles 194, 202 in a downward position until such time forklift tines entering through the forklift tine openings of pallet frame 152 contact and push either of paddles 194, 202 with sufficient force to overcome the biasing force of torsion spring 198. Intermeshing miter gears 196, 206 cause secondary actuator paddle 202 to pivot synchronously with primary actuator paddle 194, and vice versa, so that activation of either of paddles 194, 202 will rotate primary actuator shaft 192 about its longitudinal axis.

The opposite ends of primary actuator shaft 192 are fitted with cam bearings 199, which are disposed immediately below the inner wings of rocker arms 188, 189. In a non-actuated mode in which paddles 194, 202 extend vertically downward, cam bearings 199 are situated side-by-side. In an actuated mode brought about by forklift-tine activation of either of paddles 194, 202, cam bearings 199 rotate about the axis of primary actuator shaft 192 so that one of the cam bearings is positioned above the other. The raised cam bearing pushes the inner wings of rocker arms 188, 189 upward from below, pivoting rocker arms 188, 189 and thereby rotating first and second coupling shafts 180, 181 fixed thereto.

Operation of the automatic locking mechanisms will now be described. Forklift tines of a forklift are inserted into entryway openings of pallet frame 152 in accordance with normal pallet lifting and moving operations. Depending upon the direction in which the forklift tines enter pallet frame 152, the forklift tines will contact either primary actuator paddle 194 or secondary actuator paddle 202. Intermeshing miter gears 196, 206 will cause primary and secondary actuator shafts 192, 200 about their respective axes to rotate (and both paddles 194, 202 to pivot upward) synchronously upon forklift-tine activation of either of paddles 194, 202. The rotational movement of primary actuator shaft 192 rotates cam bearings 199 affixed at the ends thereof ninety degrees into a vertical position. Referring to FIG. 10, whichever cam bearings 199 are raised lift the inner wings of rocker arms 188, 189, which in turn rotates first and second coupling shafts 180, 181 about their respective axes. Rotation of first coupling shaft 180 causes devises 182 at the opposite ends of first coupling shaft 180 to pivot, translating their attached locking bolts 172 away from respective corner posts 158. Simultaneously, rotation of second coupling shaft 181 causes devises 183 at opposite ends of second coupling shaft 181 to pivot, translating their attached locking bolts 172 away from respective corner posts 158. The translational movement of locking bolts 172 away from their respective corner posts disengages locking bolts 172 from interface fittings of another pallet, rack post, container wall, trailer bed, etc., on which pallet 150 rests.

As indicated from the above description and the accompanying drawings, the automatic locking feature of this embodiment of the invention permits locking mechanisms at each of the four corners of pallet 150 to automatically and concomitantly engage and disengage respective interface fittings at the corners of another pallet, rack, container, trailer bed, etc., on which pallet 150 rests. It should be understood that the embodiment may be modified to permit automatic and concomitant locking to one, two, three, or more interface fittings.

FIG. 12 illustrates the above embodiment in an override mode, which is effected by inserting hairpin 174 into second hole 172*b*. Abutment of hairpin 174 against stationary block 175 prevents the biasing force of spring 170 from translating locking bolt 172 towards corner post 158 and into corner post cavity 168. As a consequence, the locking mechanisms of pallet 150 are retained out of locking engagement irrespective of whether a forklift tine has entered pallet frame 152. It is easiest to insert hairpins 174 into second holes 172*b* when either of paddles 194, 202 is actuated with a forklift tine, because the force applied by the forklift tines will overcome the biasing force of torsion spring 198 and place locking bolts 172 in a position in which hairpins 174 may be inserted into second holes 172*b*.

FIGS. 13-21 depict an embodiment of a collapsible container 210 in which pallet 150 serves as a support base. Collapsible container 210 further comprises a front panel 212, rear panel 214, first side panel 216, and second side panel 218. It should be understood that one or more of panels 212, 214, 216, 218 may be replaced with an alternative wall structure, such as a mesh. A top cover 228 rests on the upper edges of panels 212, 214, 216, and 218. First and second side panels 216, 218 both have corner posts 219 at their opposite sides. As best shown in FIG. 19B, each corner post 219 also includes an outward facing recessed barrel pin 221 for reinforcement purposes which will become clearer from the description below. An interface fitting 225 is positioned on top of each corner post 219. Slots formed at each corner of top cover 228 receive interface fittings 225 to allow top cover 228 to rest on the tops of corner posts 219.

Figures 19A, 19B:
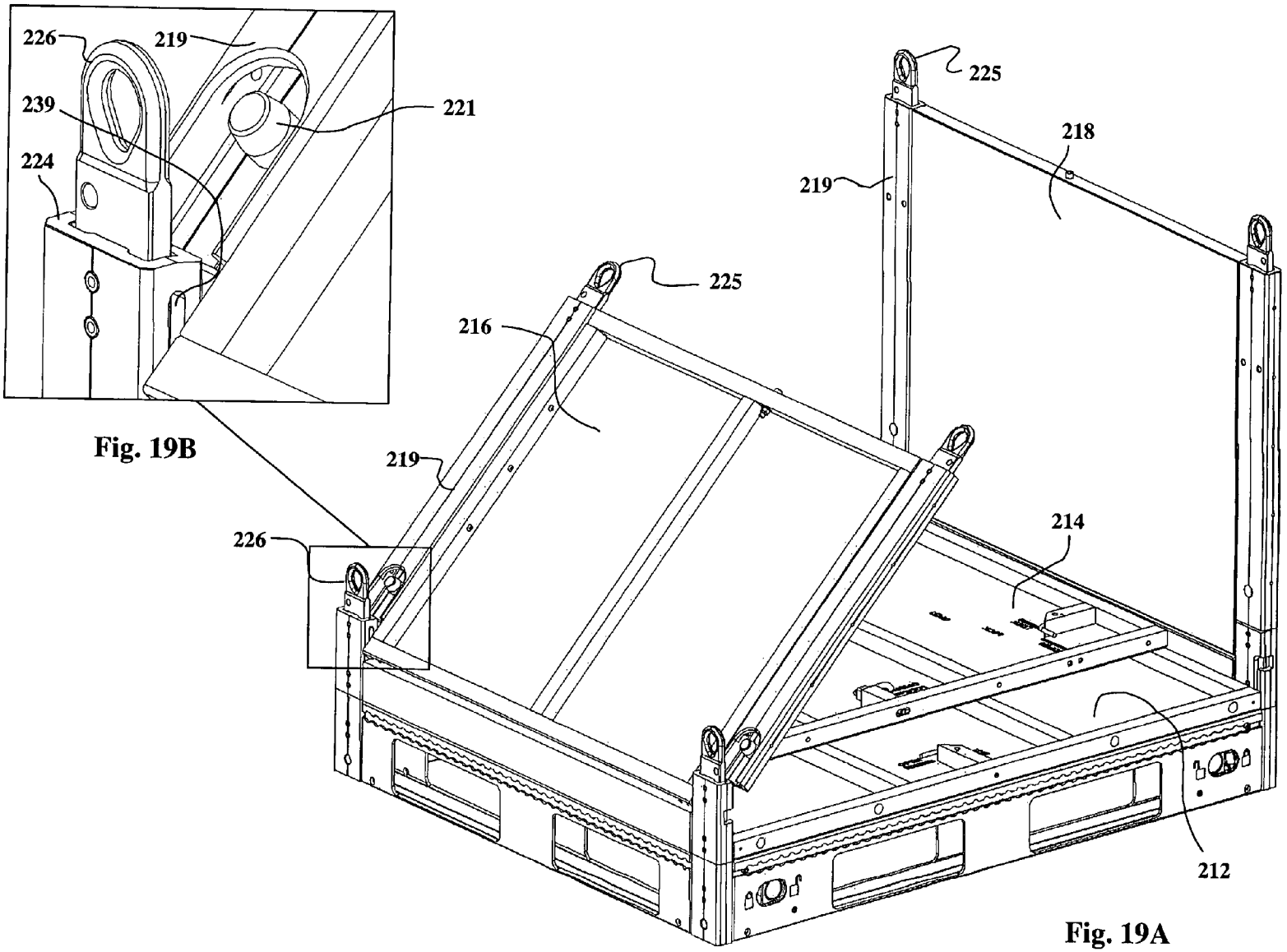

First and second side panels 216, 218 rest on first and second skirt members 220, 222, respectively. Skirt members 220, 222 both have skirt corner posts 224 at their opposite ends, and a skirt interface fitting 226 extending above each skirt corner post 224. When side panels 216, 218 are in their upright position, barrel pins 221 are received in skirt interface fittings 226 for reinforcement of side panels 216, 218. As shown in FIG. 19B, inward folding movement of side panels 216, 218 disengages barrel pins 221 from skirt interface fittings 226 as container 210 is converted to its collapsed position.

The construction of collapsible container 210 features the vertical alignment of interface fittings, which is instrumental in enhancing system modularity, as described in greater detail below. Each of the skirt interface fittings 226 is positioned directly below a corresponding upper interface fitting 225. Accordingly, the collapsible container 210 includes a plurality of parallel upper interface fittings. Further, interface fittings 166 of pallet 150, which are received through openings in the bottom surfaces of skirt corner posts 224, are vertically aligned with interface fittings 225, 226. Locking bolts (not shown) may be employed to connect skirt corner posts 224 to interface fittings 166. Alternatively, for example, skirt corner posts 224 may be permanently connected with pallet 150, thereby permitting interface fittings 166 to be eliminated from pallet 150.

Each of the skirt corner posts 224 possesses a respective inward-facing guide track 232. As best shown in FIG. 16B, guide track 232 includes a substantially vertical oblong channel portion and an associated horizontal channel opening portion terminating at the edge of skirt corner post 224. Lateral tracking pins protrude outwardly from opposite edges of front panel 212. The tracking pins are inserted into the horizontal channel opening portions of guide tracks 232, then slid downward to the bottom of the vertical oblong channel portion of guide track 232 to set panel 212 in its erect position. Similarly, rear panel 214 has lateral tracking pins protruding outwardly from its opposite side edges for slidingly engaging guide tracks 232 of rear skirt corner posts 224.

Figure 13:
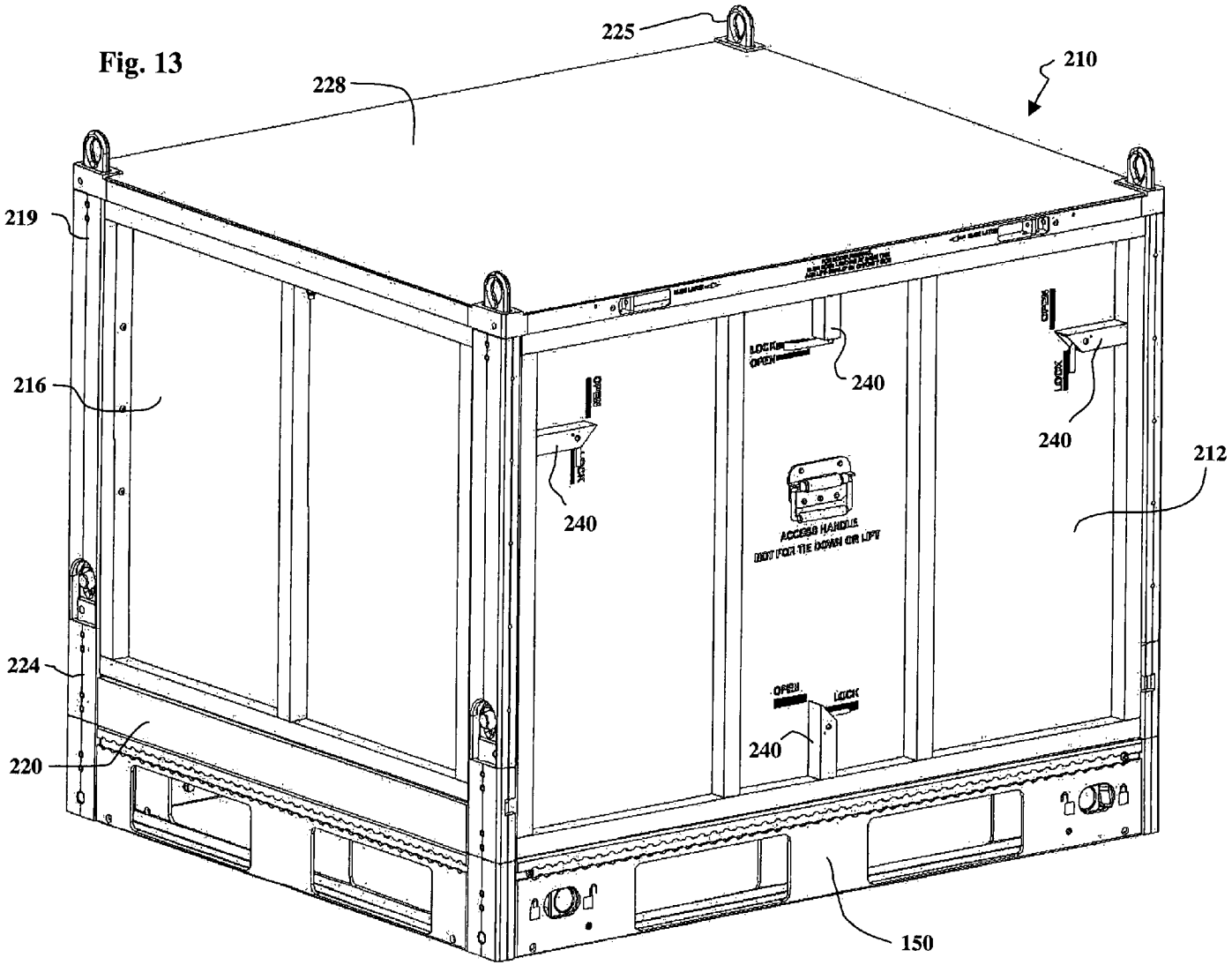
FIGS. 13 and 14 are perspective views of a collapsible container platform depicted in erect and collapsed positions with the cover removed, respectively.
Figure 14:
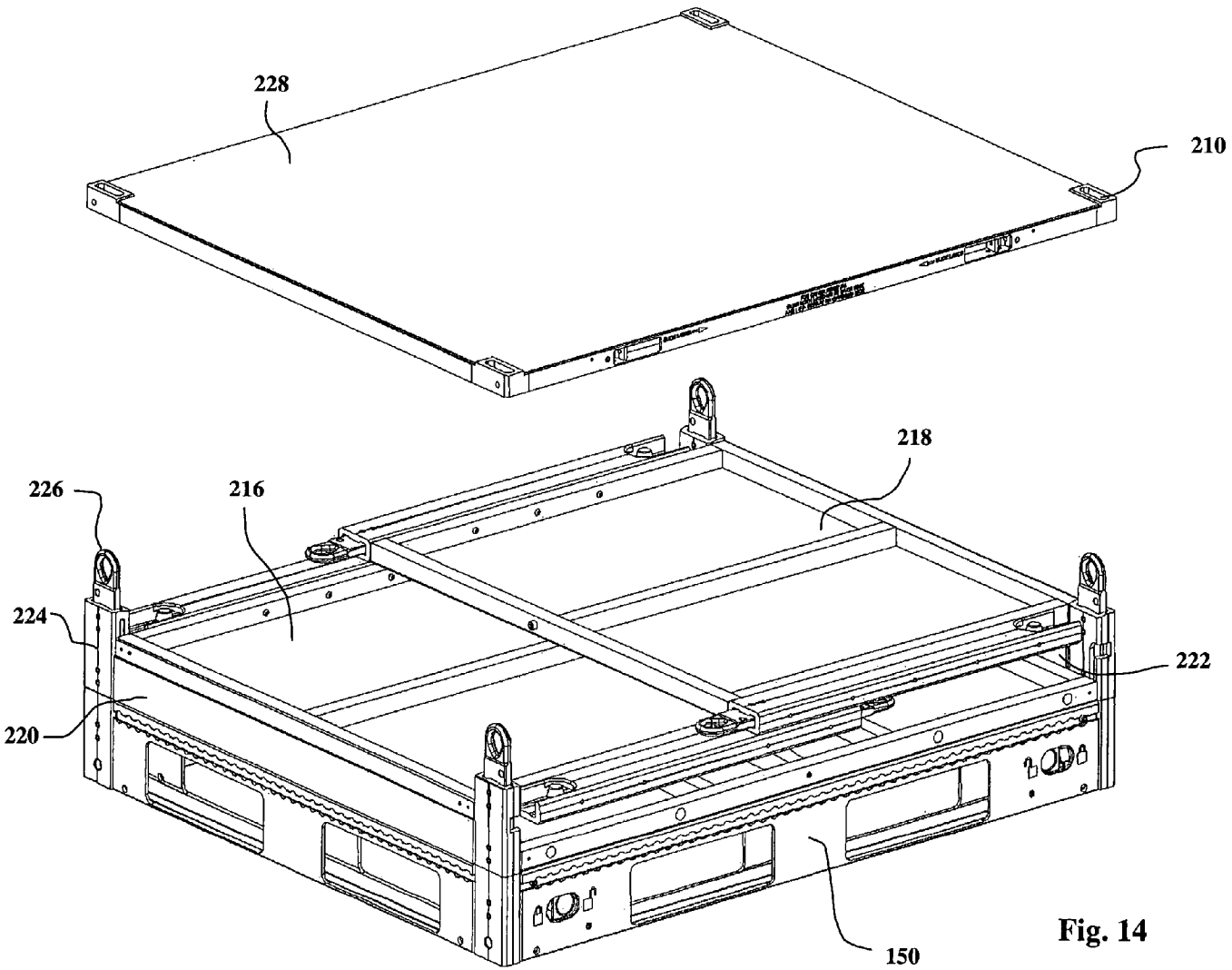
Figure 15:
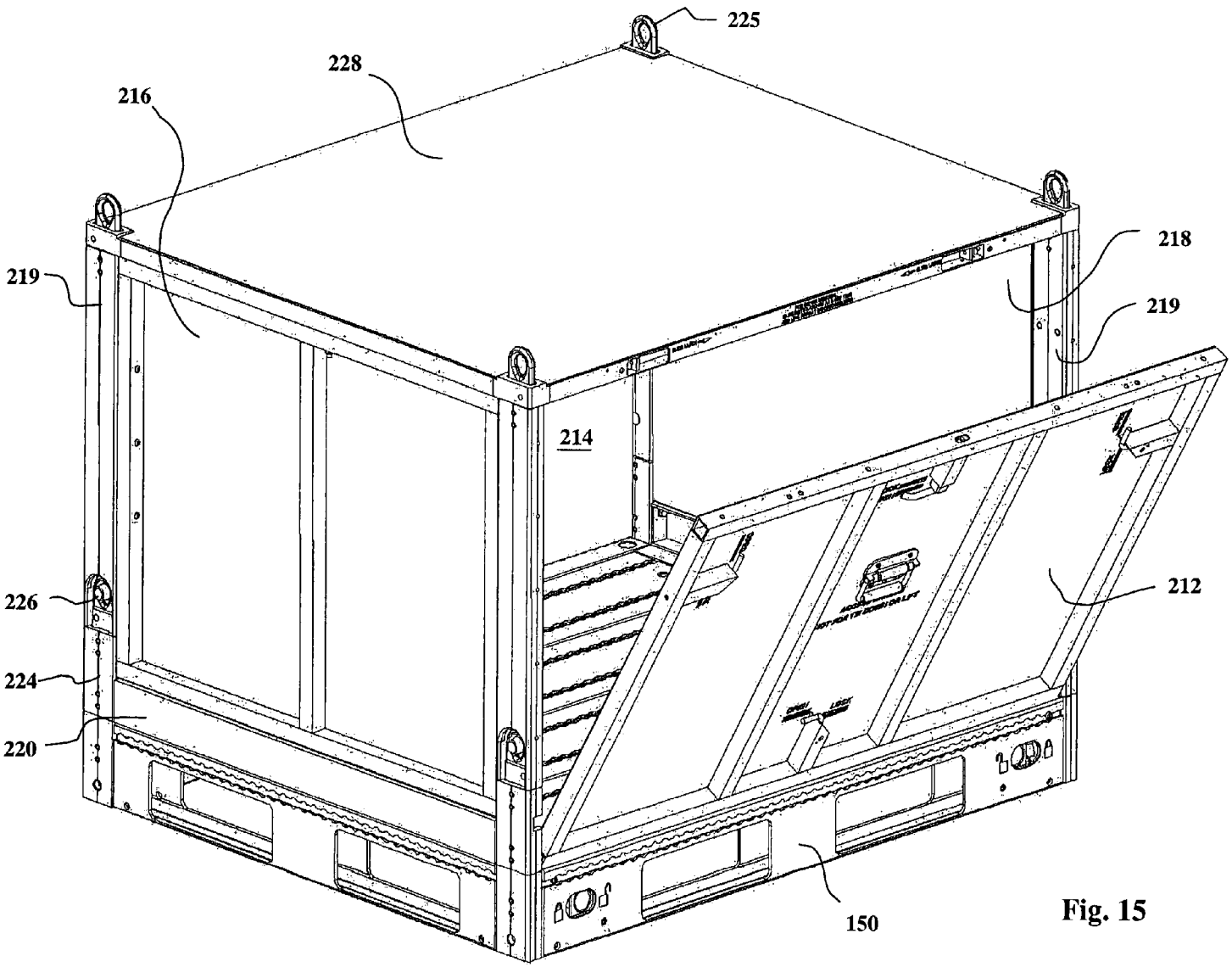
FIG. 15 is a perspective view of a step for opening and/or removing a front panel of the collapsible container.
Figure 16A:
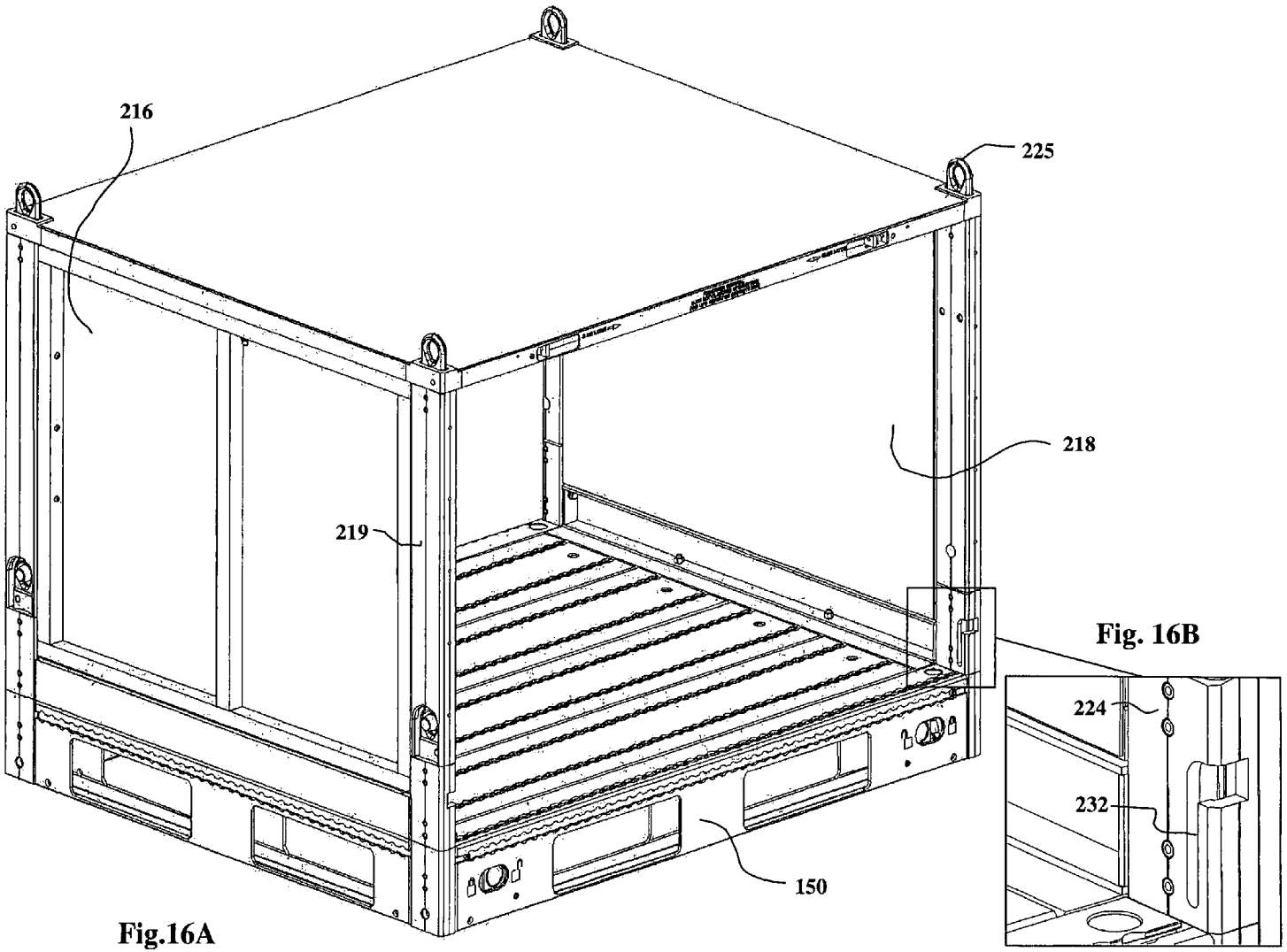

From the erect position shown in FIG. 13, front panel 212 is pivotal about its tracking pins outwardly or inwardly by disengaging latches 240 securing front panel 212 to side walls 216, 218, pallet 150, and top cover 228. As shown in FIG. 15, front panel 212 may be pivoted outwardly to permit access to the compartment of container 210. Outward pivotal movement may be continued until the top edge of front panel 212 comes to rest on the ground, so that front panel 212 establishes a ramp for loading and unloading goods into pallet 150. Alternatively, once front panel 212 is pivoted outwardly to an angled state, such as shown in FIG. 15, front panel 212 may be detached from skirt corner posts 224 by sliding the tracking pins along guide tracks 232 and through the channel opening portions of guide tracks 232. Detachment of front panel 212 from the remainder of container 210 permits unobstructed front access to the container compartment, as shown in FIG. 16A. It should be noted that front panel 212 is detachable without requiring the removal of top cover 228 or another pallet (not shown in FIG. 13) resting on corner posts 224. Rear panel 214 may be similarly angled and detached.

Figure 17:
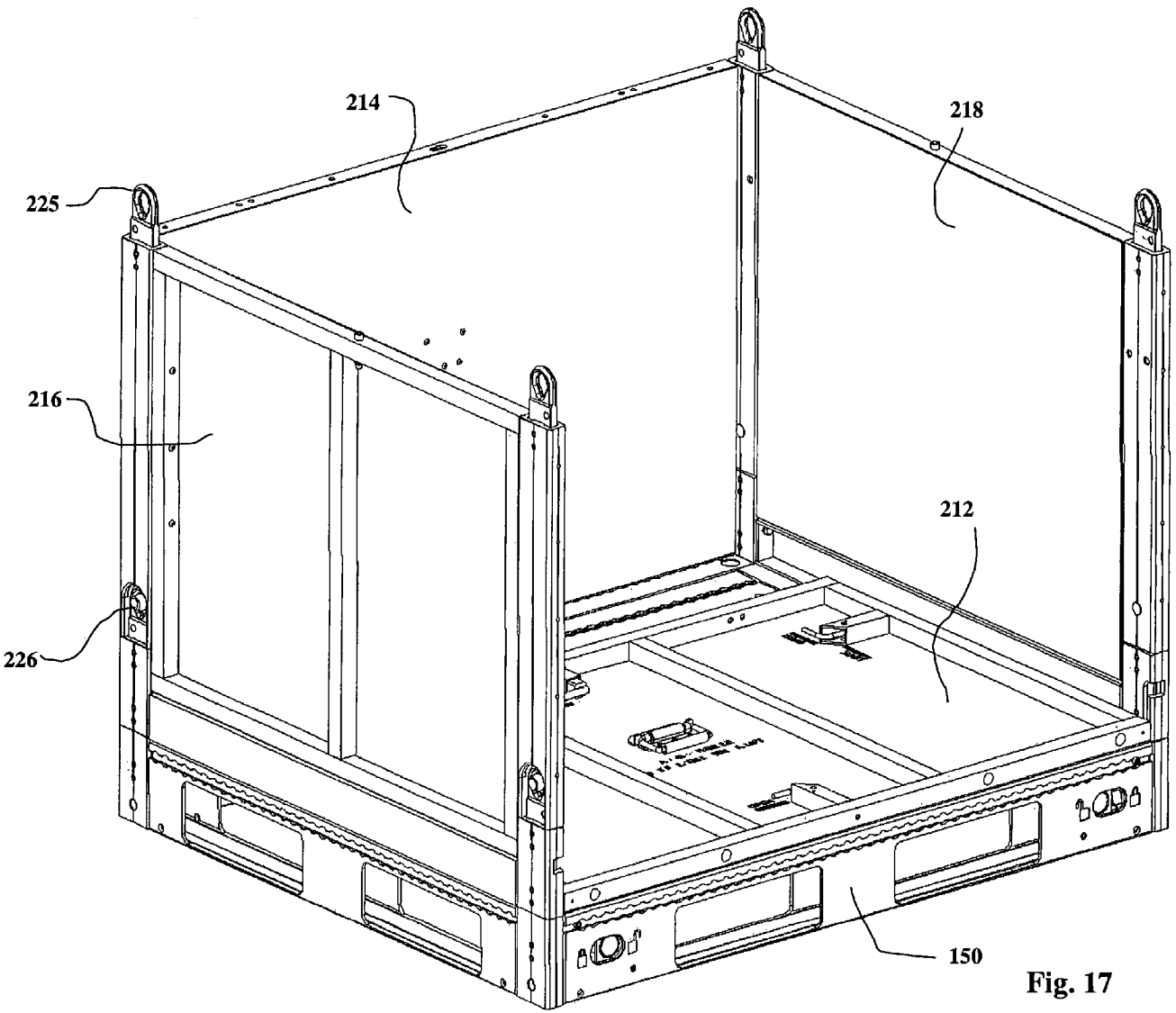
FIGS. 17, 18, 19A, and 19B are perspective views of a sequence of steps for converting the collapsible container of FIGS. 13 and 14 from the erect position to the collapsed position.
Figure 18:
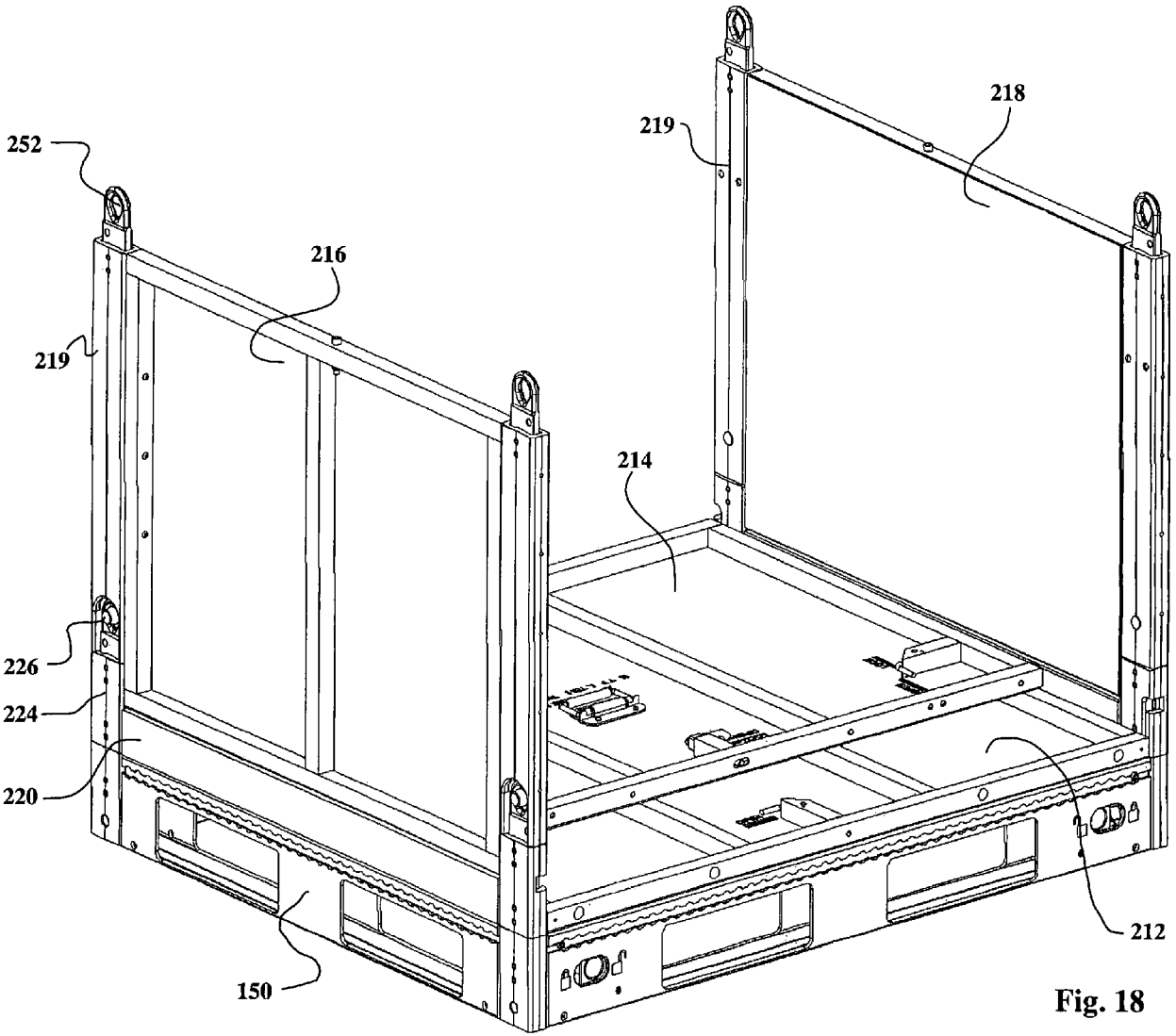

Front and rear panels 212, 214 are collapsible inward onto pallet 150 as shown in FIGS. 17 and 18. Top cover 228 generally is removed prior to collapse of front and rear panels 212, 214, and latches 240 on both front and rear panels 212, 214 are disengaged. An aspect of collapsible container 210 is that front and rear panels 212, 214 may be collapsed flat onto pallet 150 irrespective of the sequence in which panels 212, 214 are folded inward. The vertical oblong channel portions of guide tracks 232 permit the base of the subsequently folded panel 212 or 214 to be raised upward while tracking pins remain engaged in the vertical oblong channel portions of guide tracks 232, thereby placing the base of the subsequently folded, raised panel 212 or 214 above the body of the previously folded panel 212 or 214. The raised panel 212 or 214 is permitted to fold down into a horizontal orientation on top of the other panel 212 or 214. In this manner, both panels 212, 214 are arranged in a compact horizontal position to minimize the storage area consumed by the collapsed container.

As shown in FIGS. 19A and 19B, folding of side panels 216, 218 onto front and rear panels 212, 214 also is sequence independent. Opposite edges of each of side panels 216, 218 have track pins (not shown) protruding outwardly into vertical oblong guide tracks 239. Either of side panels 216 or 218 may be folded inward prior to the other, coming to rest on panel 212 or 214. The remaining side panel 216 or 218 is raised upward as its outwardly protruding track pins move upward along guide tracks 239, thereby allowing the remaining side panel 216 or 218 to be subsequently folded inward to a flat, horizontal position on the previously folded panel.

Figure 21:
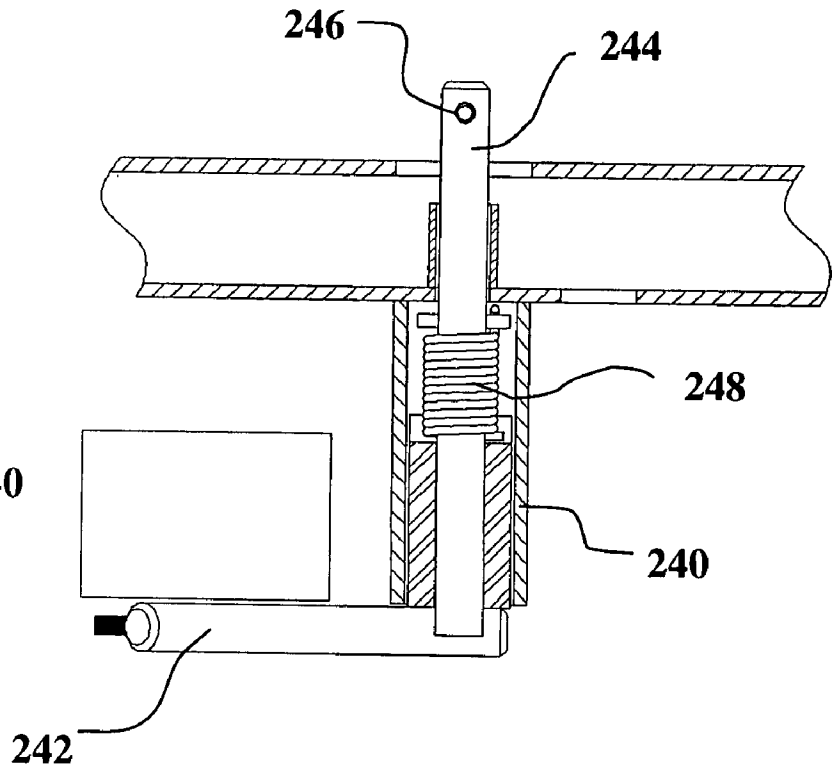
FIGS. 20 and 21 are perspective and partially sectioned views, respectively, of a latching mechanism of the collapsible container of FIGS. 13 and 14.
Figure 20:
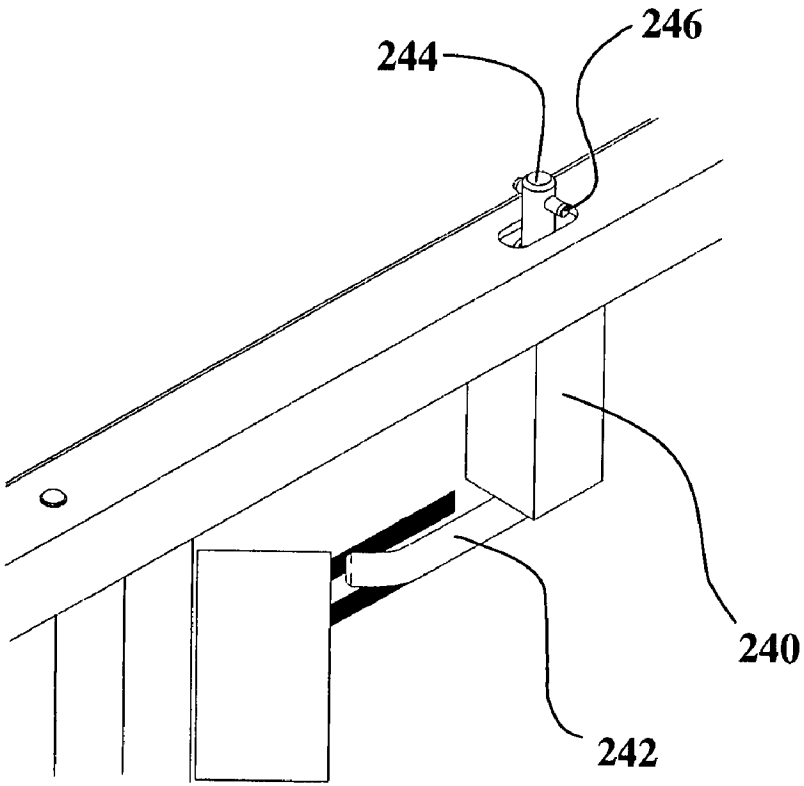
Figures 22A, 22B:
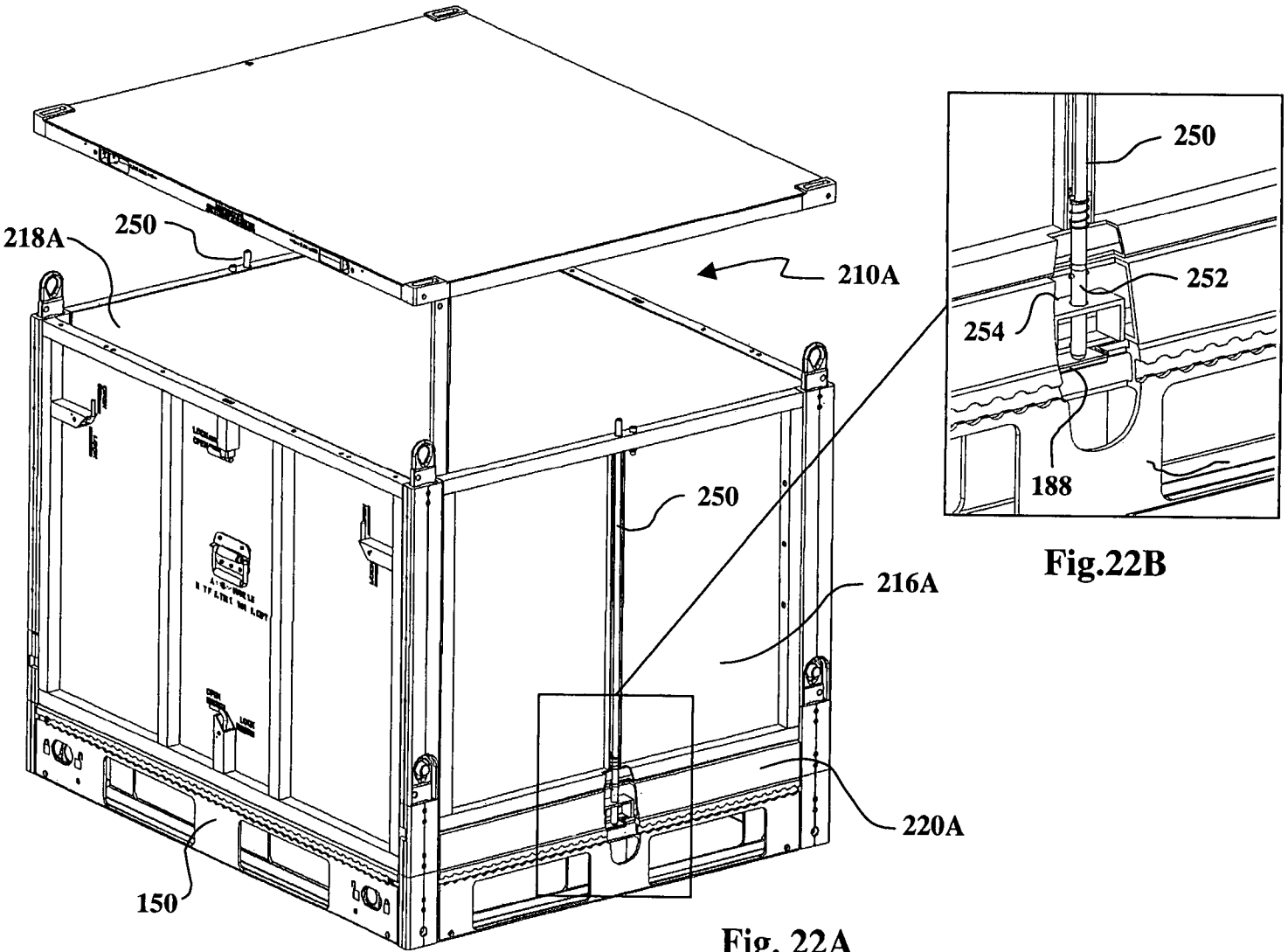
FIGS. 22A, 22B, 23, and 24 are perspective views of the collapsible container of FIGS. 13 and 14 modified to include a top-actuating, automatic locking mechanism.

An exemplary latch 240 is shown in FIGS. 20 and 21. Latch 240 includes a handle 242 fixedly connected to a locking pin 244. A spring, e.g., a torsion spring or compression spring, 248 urges handle 242 into a locked position shown in FIGS. 20 and 21. Latch 240 may be grasped by an operator and pivoted outward away from the face of front panel 212 to rotate locking pin 244 about ninety degrees. Radially protruding arms 246 of locking pin 244 are thereby disengaged from a counterpart receptacle (not shown) of side walls 216, 218, pallet 150, or top cover 228. Handle 242 is moved to retract locking pin 244 and protruding arms 246 from the counterpart receptacle. It should be understood that various latching mechanisms may be substituted for or used in combination with latch 240.

Figure 23:
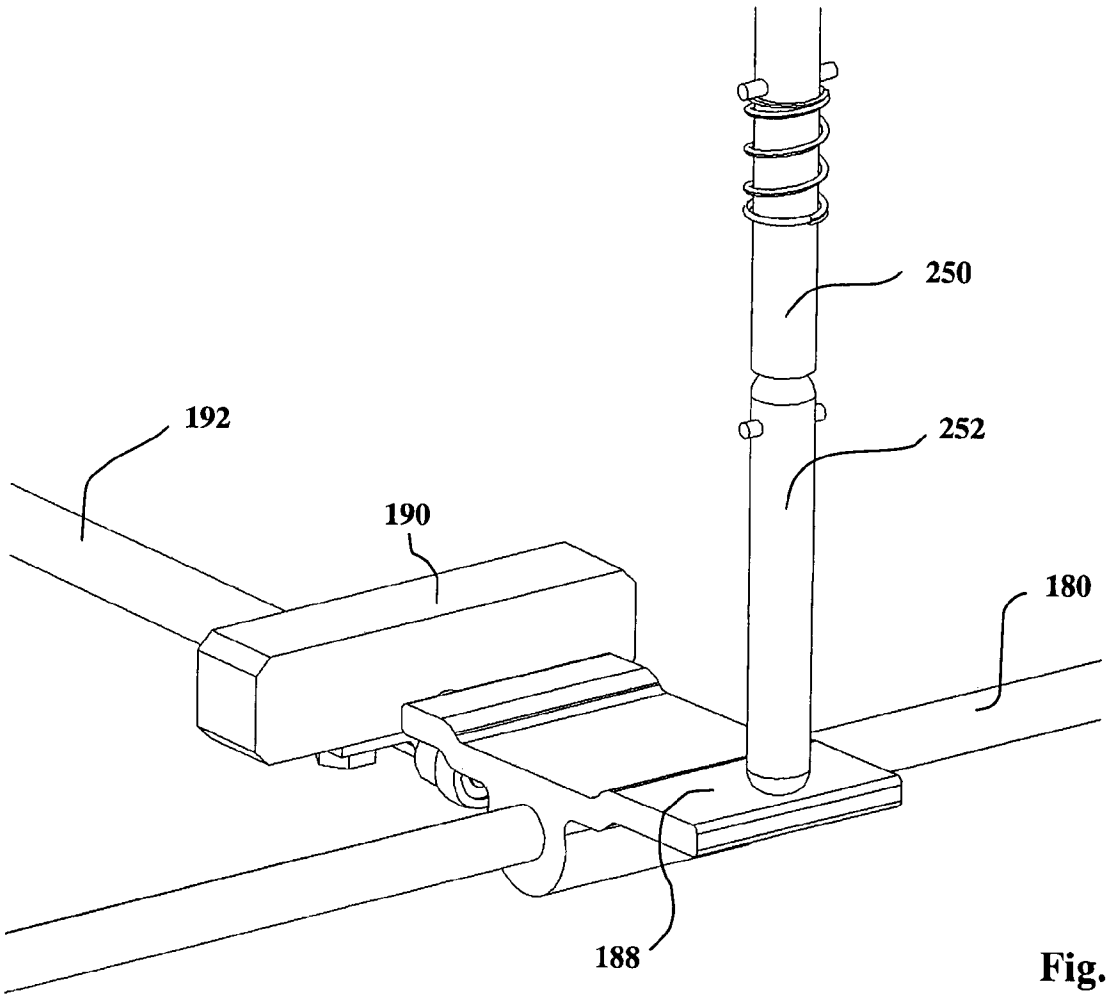
Figure 24:
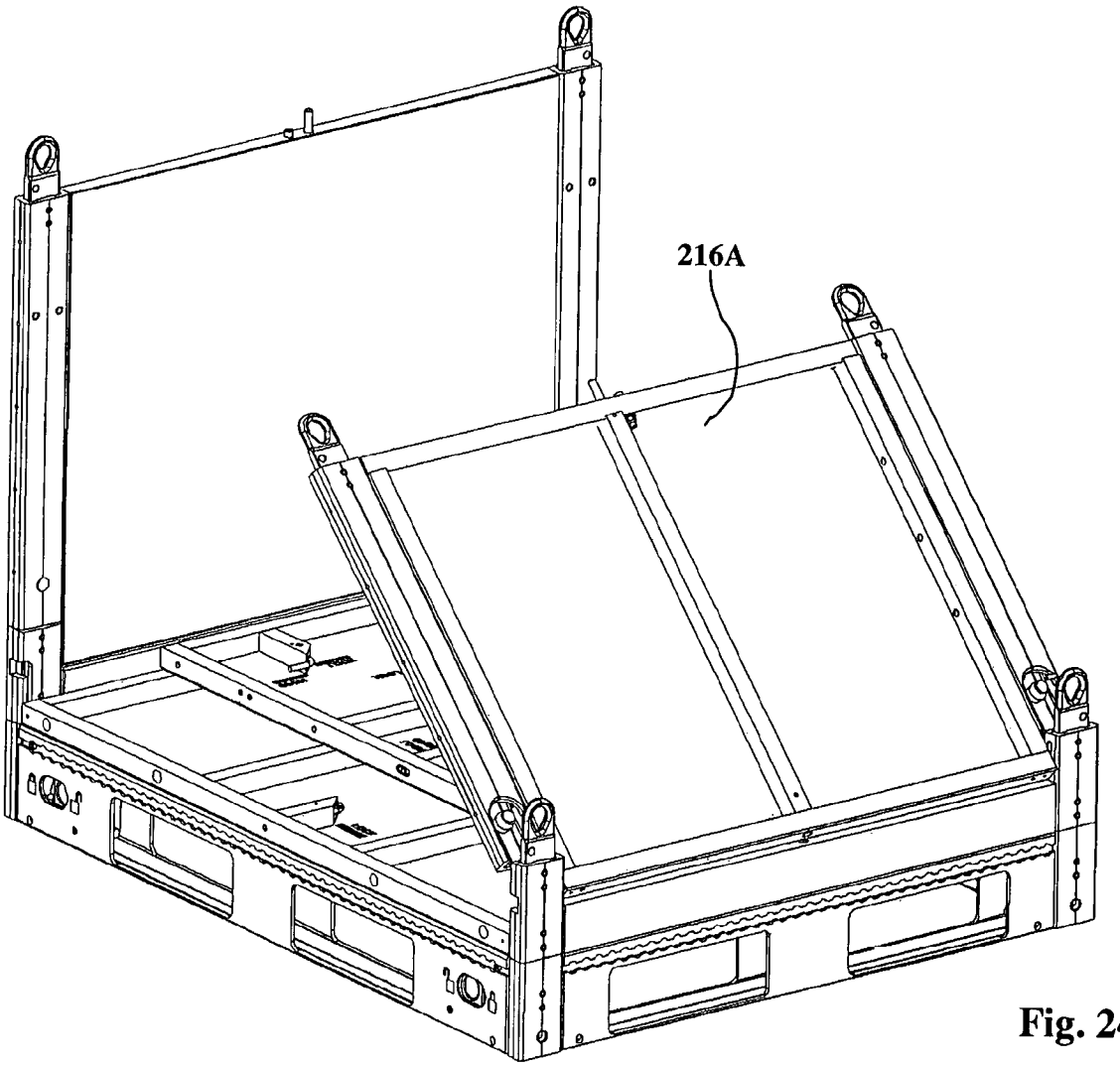

FIGS. 22A, 22B, 23, and 24 depict a collapsible container 210A including a top-actuating, automatic locking mechanism for use in overhead handling applications where automatic unlocking of containers from one another or unlocking of a container from a deck is an aspect. The automatic locking mechanism includes an upper push rod 250 extending from above the top edge to the bottom edge of side panel 216A. As shown in FIG. 23, a lower push rod 252 sits on the outer wing of rocker arm 188 in vertical alignment with upper push rod 250. Bracket 254 retains the upper end of lower push rod 252 aligned with and in contacting relationship with the lower end of upper push rod 250 at a position corresponding to the interface of side panel 216A and skirt member 220A. As best shown in FIG. 24, the division of the push rod actuating mechanism into upper push rod 250 and lower push rod 252 permits side panel 216 to be folded inward into a collapsed position without impediment from the top-actuating, automatic locking mechanism. Push rods 250, 252 separate from contact with one another when side panel 216A is folded inward. Although not shown in complete detail, it should be understood that an identical top-actuating, automatic locking mechanism is found at opposite side panel 218A.

Figure 40:
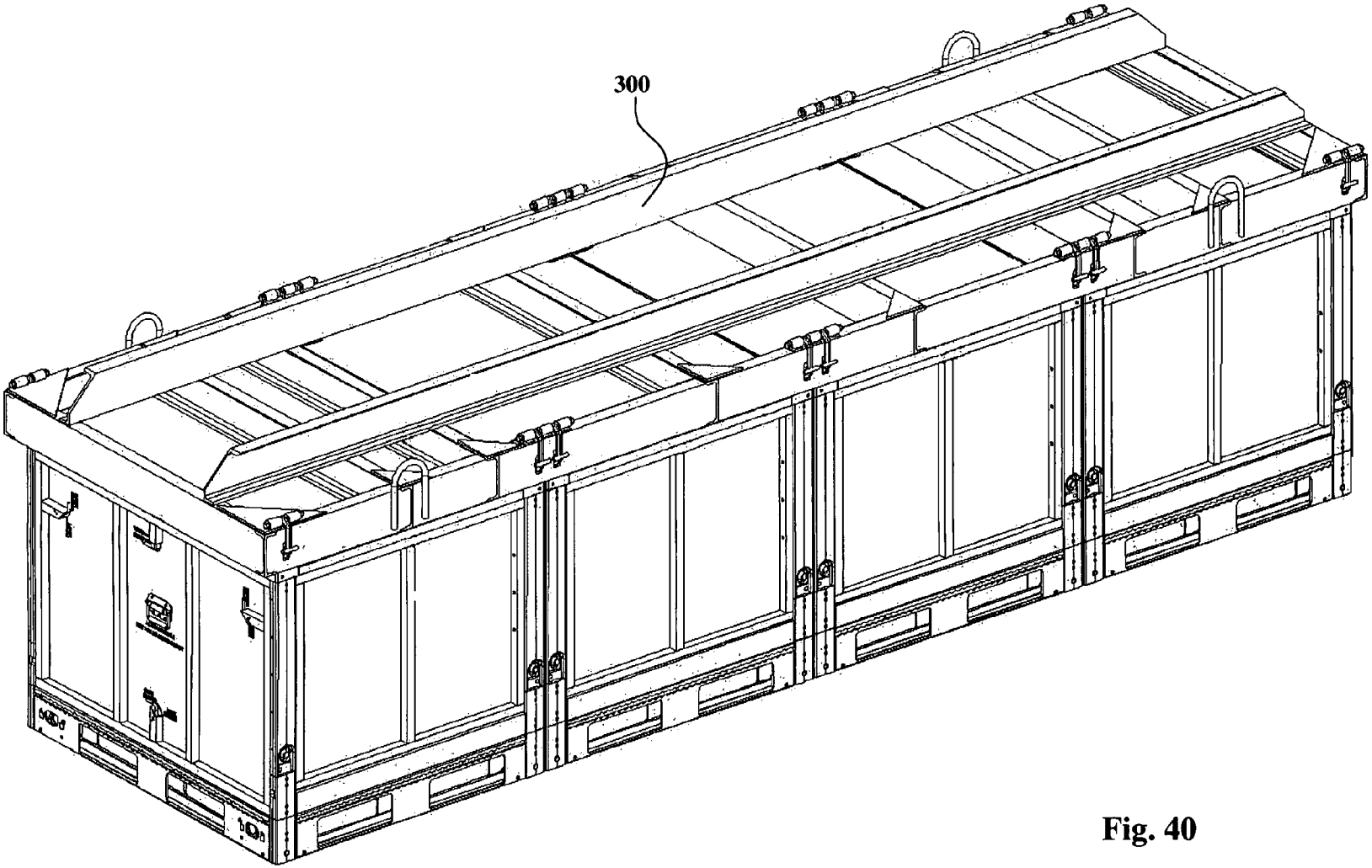
FIG. 40 is a perspective view of an overhead lifting mechanism suitable for moving one or more storage assemblies of the invention.

In operation, upper push rods 250 of side panels 216A, 218A each are depressed from above to unlock the locking bolts 172 of pallet 150 from another structure (e.g., container, rack, pallet, trailer bed, etc.) on which pallet 150 sits. For example, a top lifting frame 300 as shown in FIG. 40 may cause depression of the upper push rods 250. Depression of upper push rods 250 displace lower push rods 252 downward, which forces the outer wings of rocker arms 188, 189 downward so that rocker arms 188, 189 pivot. Pivotal movement of rocker arms 188, 189 causes first and second coupling shafts 180 fixed thereto to rotate about their axes. As described in detail above, devises 182 at the opposite ends of first coupling shaft 180 and devises 183 at the opposite ends of second coupling shaft 181 are pivoted and translate their attached locking bolts 172 away from respective corner posts 158. The translational movement of locking bolts 172 away from their respective corner posts disengages locking bolts 172 from interface fittings of another pallet, rack post, container wall, trailer bed, etc., on which pallet 150 rests.

Figure 30:
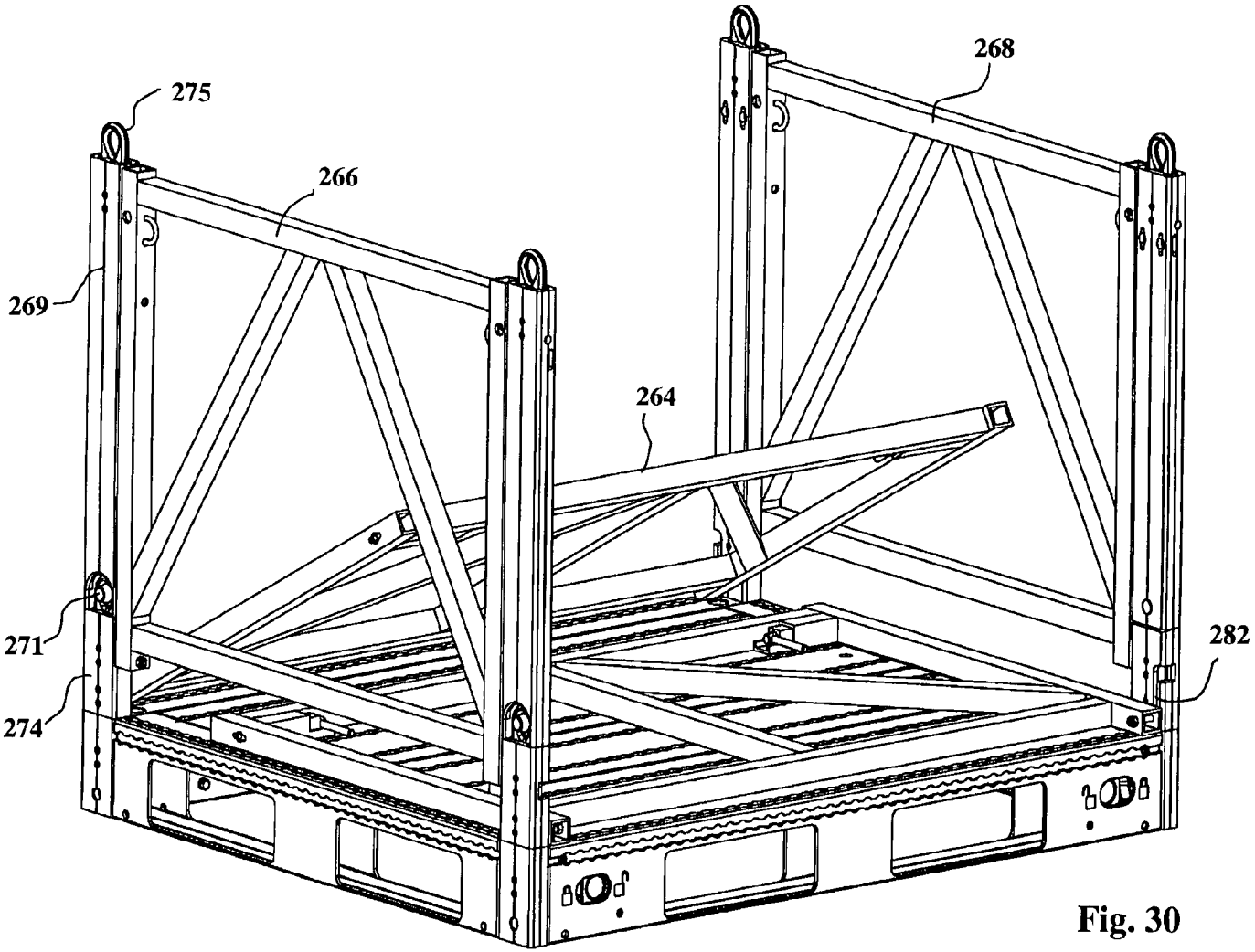
Figure 31:
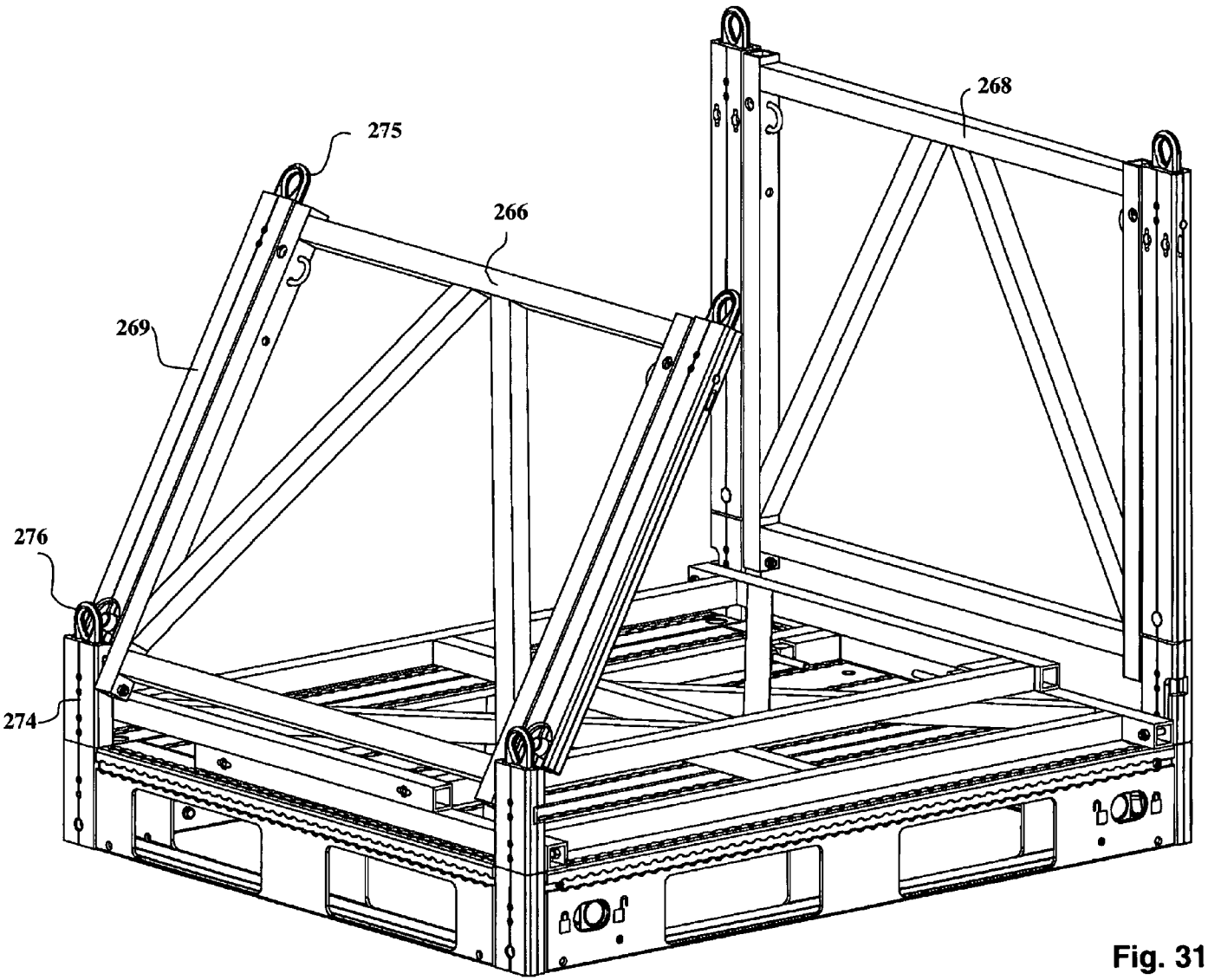
Figure 32:
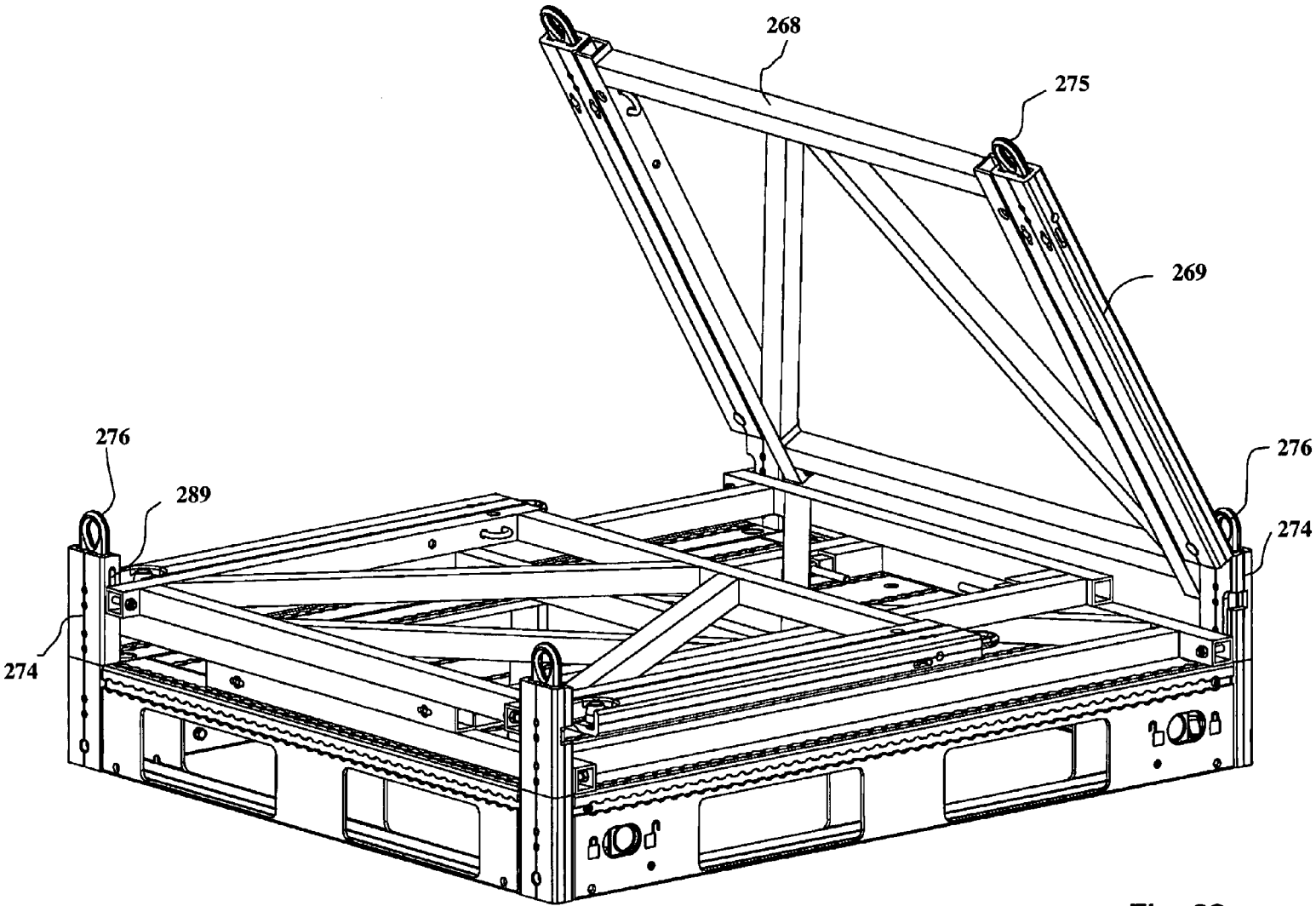

FIGS. 25-34 depict an embodiment of a collapsible rack system 260 in which pallet 150 serves as a support base. Rack system 260 is similar to container 210 in construction and operation in many respects, with a most prominent exception being the replacement of panel members 212, 214, 216, and 218 with frame members 262, 264, 266, and 268, respectively. First and second side frame members 266, 268 both have corner posts 269 at their opposite sides. As best shown in FIGS. 32 and 33B, each corner post 269 also includes an outward facing recessed barrel pin 271. An interface fitting 275 is positioned on top of each corner post 269.

Figures 33A, 33B:
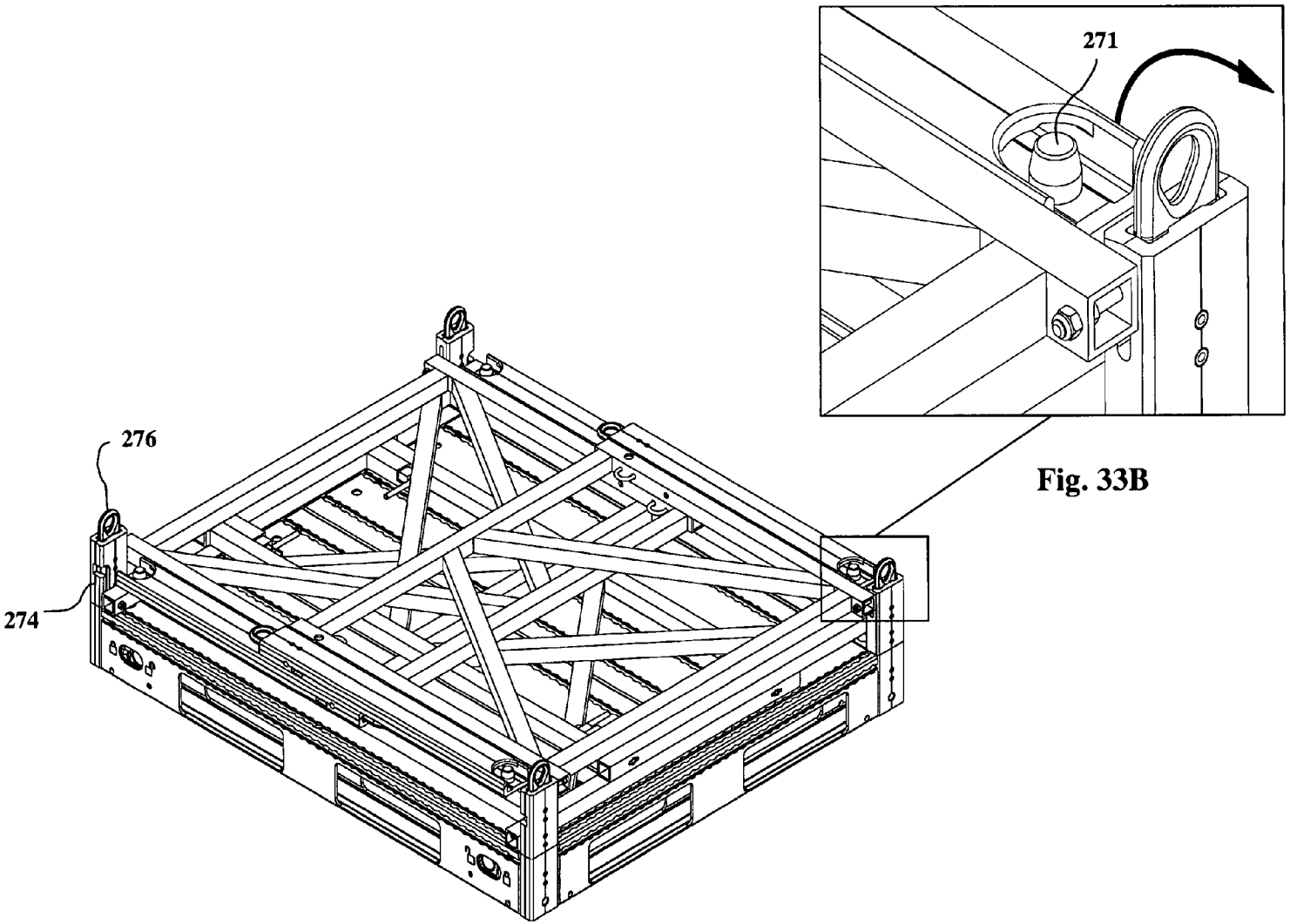

First and second side frame members 266, 268 rest on skirt corner posts 274 at their opposite ends, and a skirt interface fitting 276 extending above each skirt corner post 274. When side frame members 266, 268 are in their upright position, barrel pins 271 are received in skirt interface fittings 276 for reinforcement of side frame members 266, 268. As shown in FIG. 33B, inward folding movement of side frame members 266, 268 causes the removal of barrel pins 271 from skirt interface fittings 276 as rack system 260 is converted to its collapsed position.

The construction of collapsible rack system 260 features the vertical alignment of interface fittings, which is instrumental in enhancing system modularity, as described in greater detail below. Each of the skirt interface fittings 276 is positioned directly below a corresponding upper interface fitting 275. Further, interface fittings 166 of pallet 150 received in openings in the bottom surfaces of skirt corner posts 274 are in vertical alignment with interface fittings 275, 276. Locking bolts (not shown) may be employed to connect skirt corner posts 274 to interface fittings 166. Alternatively, skirt corner posts 274 may be permanently attached to pallet 150, thereby permitting the exclusion of interface fittings 166 from pallet 150.

Figure 28:
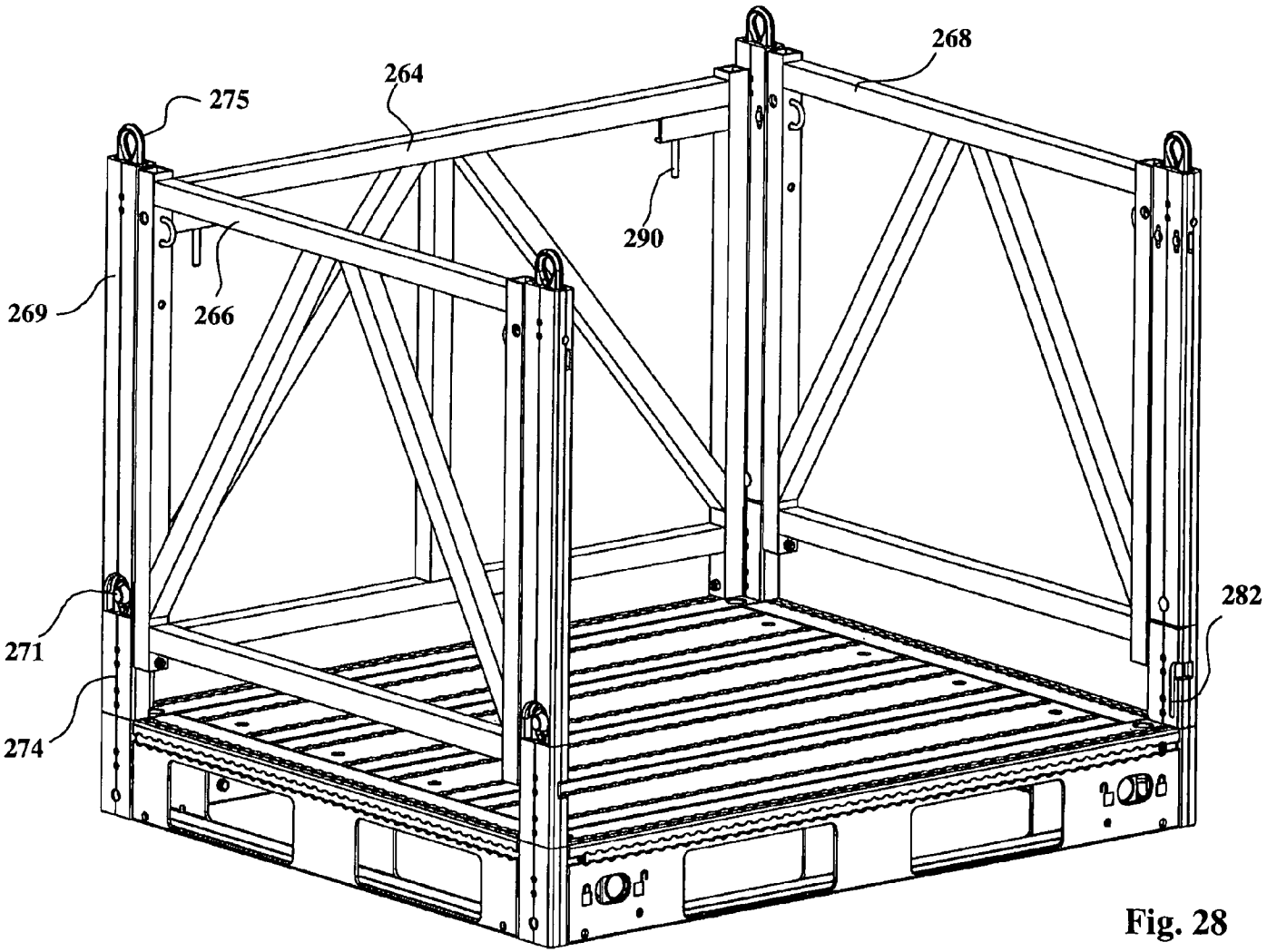
FIG. 28 is a perspective view of the collapsible rack system with the front frame member removed.

Each of the skirt corner posts 274 possesses a respective inward-facing guide track 282. As best shown in FIG. 28, guide track 282 comprises a substantially vertical oblong channel portion and an associated horizontal channel opening portion terminating at the edge of skirt corner post 274. Lateral tracking pins (not shown) protrude outwardly from opposite edges of front frame member 262. The tracking pins are inserted into the horizontal channel opening portions of guide tracks 282, then slid downward to the bottom of the vertical oblong channel portion of guide track 282 to set front frame member 262 in its upright position. Similarly, rear frame member 264 has lateral tracking pins protruding outwardly from its opposite side edges for slidingly engaging guide tracks 282 of rear skirt corner posts 274.

Figure 25:
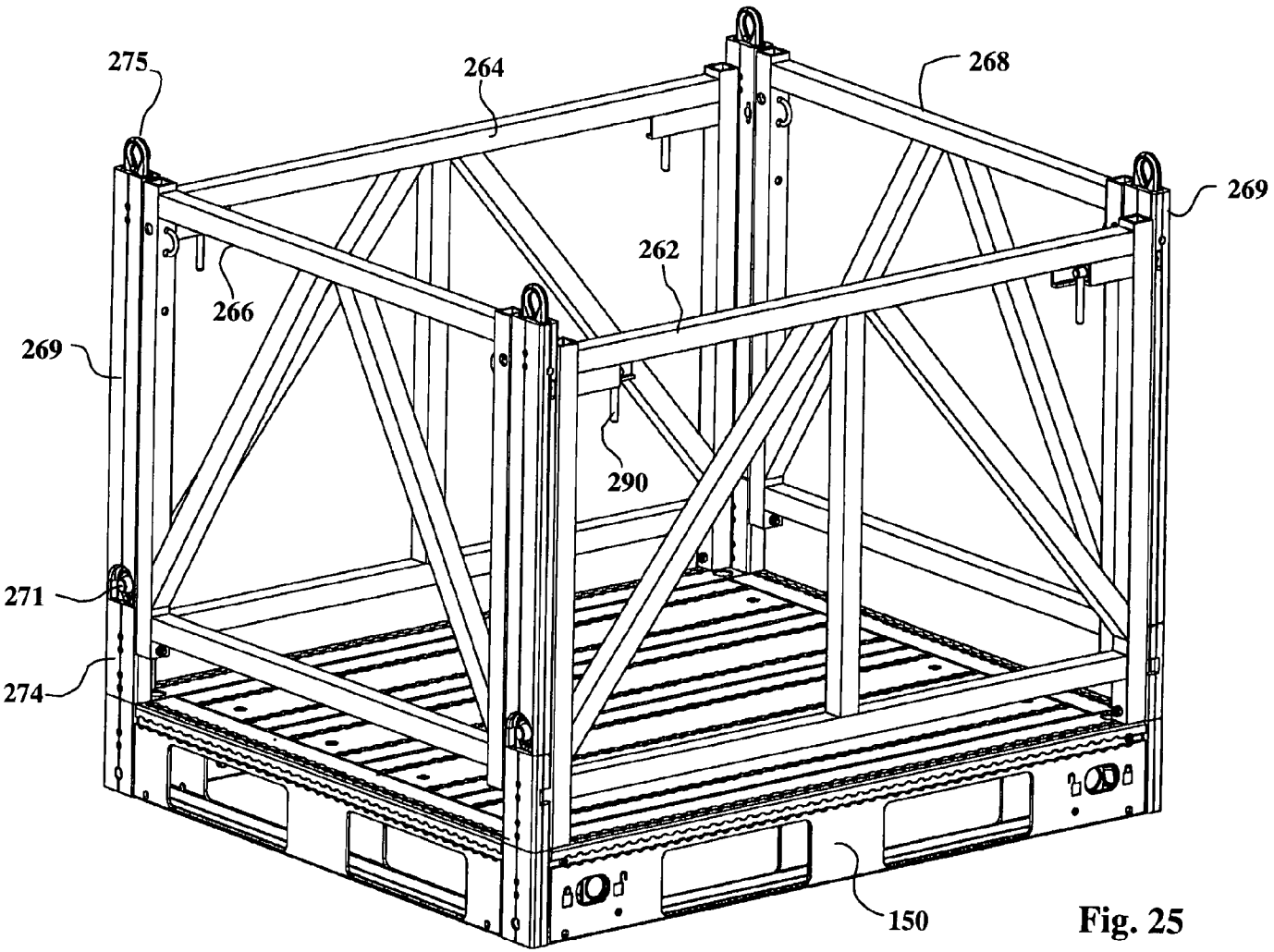
FIGS. 25 and 26 are perspective views of a collapsible rack system depicted in erect and collapsed positions, respectively.
Figure 26:
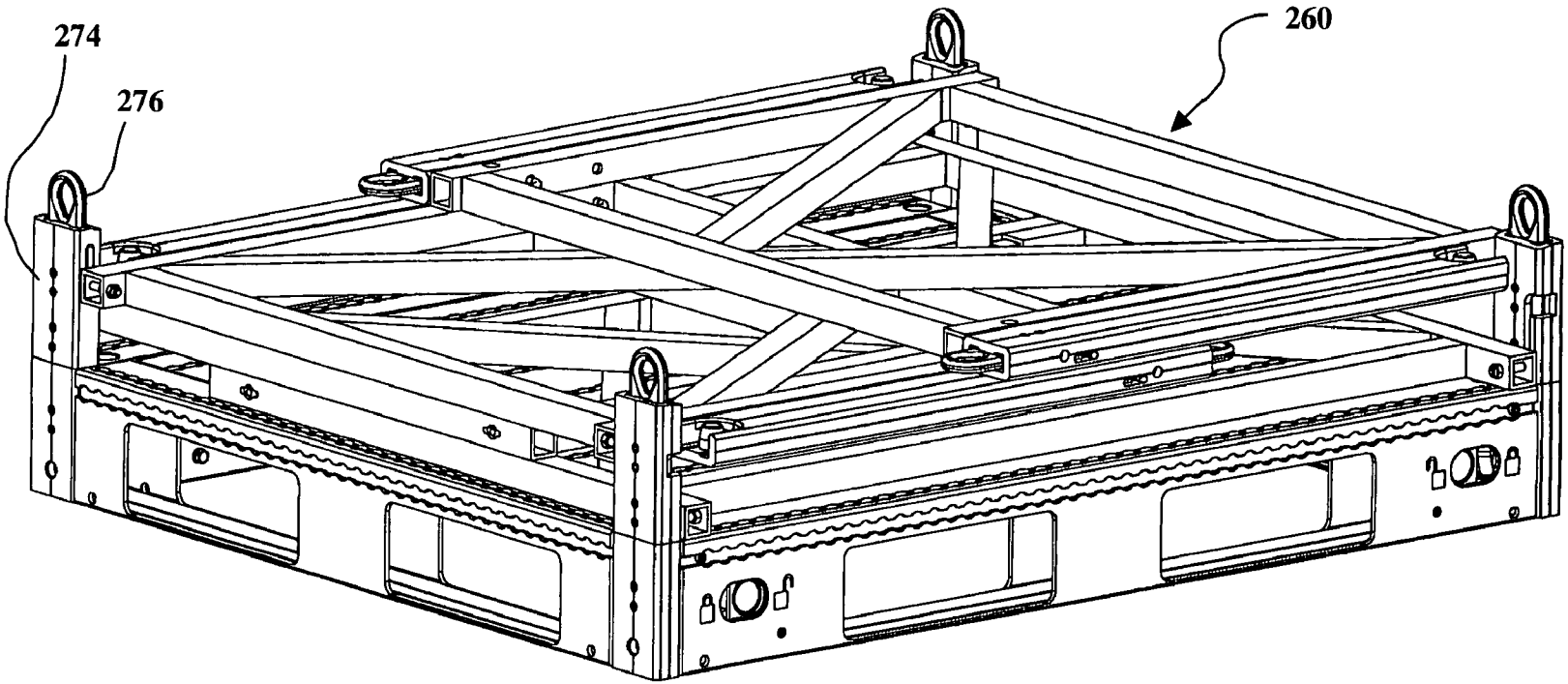
Figure 27:
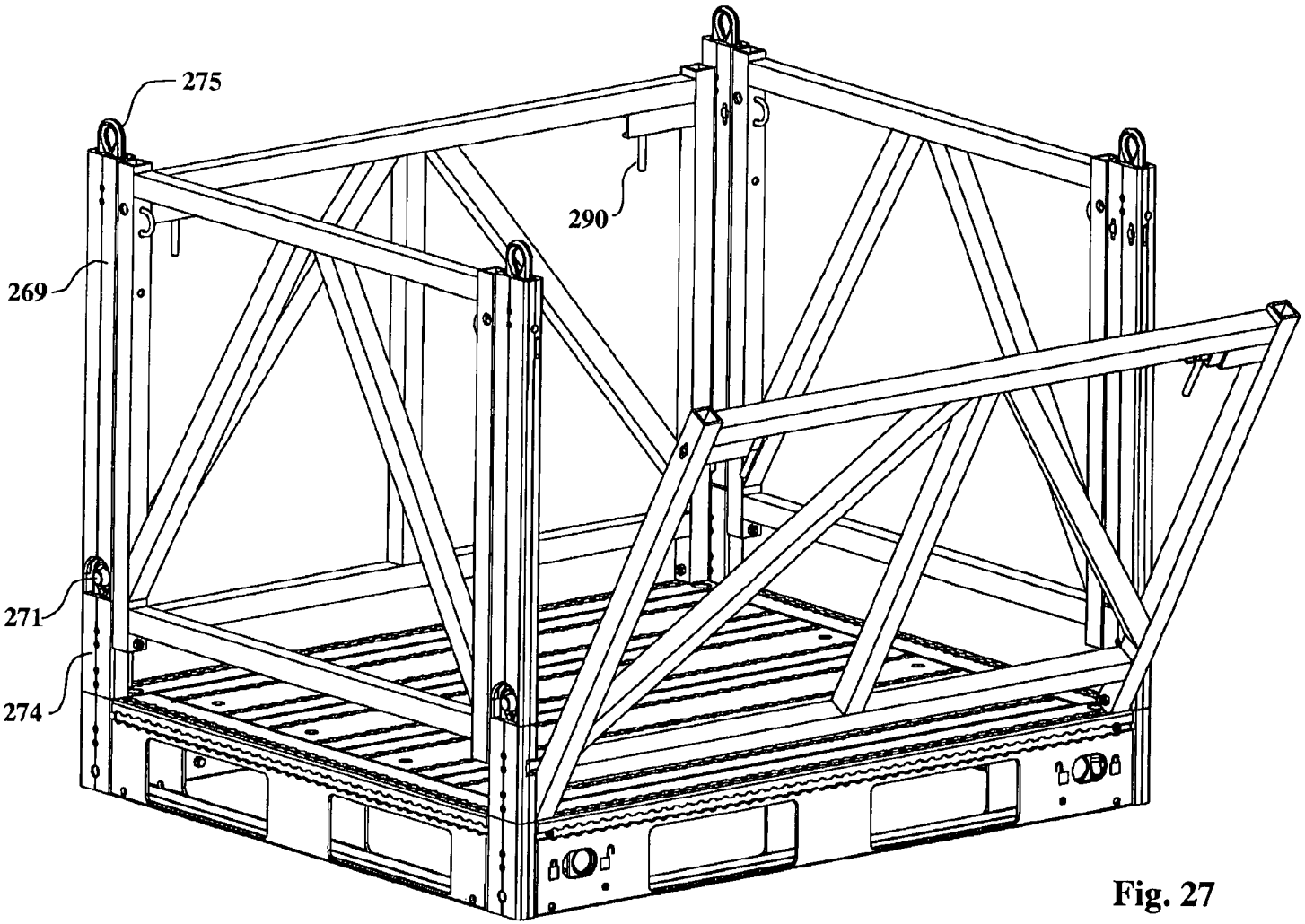
FIG. 27 is a perspective view of a step for opening and/or removing a front frame member of the collapsible rack system.

From the erect position shown in FIG. 25, front frame members 262 is pivotal about its tracking pins outwardly or inwardly by disengaging latches 290 securing front frame member 262 to side walls 266 and 268. As shown in FIG. 27, front frame member 262 may be pivoted outwardly to permit access to the compartment of rack 260. Outward pivotal movement may be continued until the top edge of front frame member 262 comes to rest on the ground. Alternatively, front frame member 262 may be detached from skirt corner posts 274 by sliding the tracking pins along guide tracks 282 and through the channel opening portions of guide tracks 282. Detachment of front frame member 262 from the remainder of rack 260 permits unobstructed front access to the rack compartment, as shown in FIG. 28. It should be noted that front frame member 262 is detachable without requiring the removal of an optional top cover or upper pallet (not shown)

resting on corner posts 274 by first angling front frame member 262 forward. Rear frame member 264 may be similarly detached.

Figure 29:
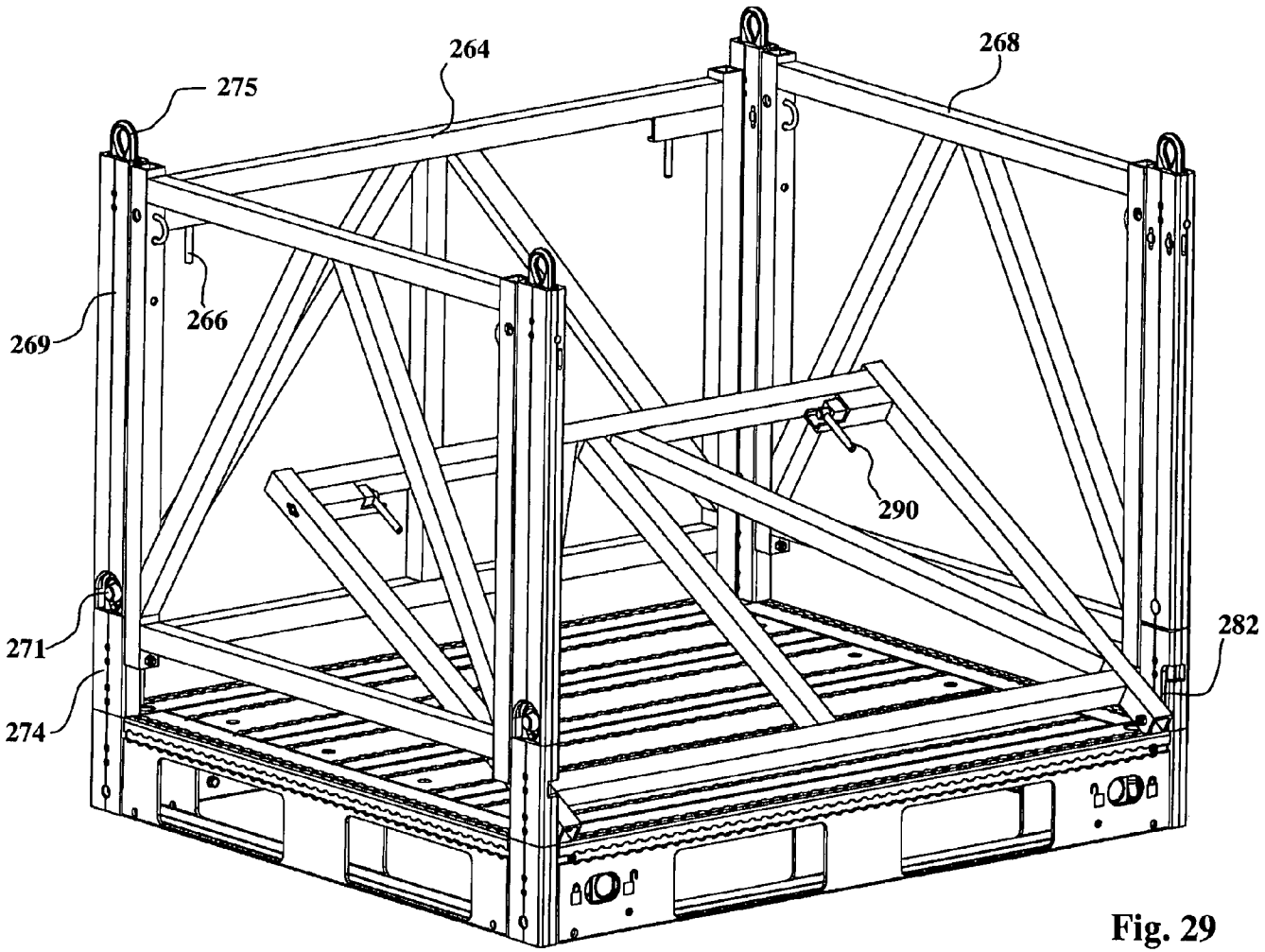
FIGS. 29-32, 33A, and 33B are perspective views of a progression of steps for converting the collapsible rack system from the erect position, FIG. 25, to the collapsed position, FIG. 26.

Front and rear frame members 262, 264 are collapsible inward onto pallet 150 as shown in FIGS. 29 and 30. Latches 290 attaching front and rear frame members 262, 264 to side frame members 266, 268 are disengaged. An advantageous feature of collapsible rack system 260 is that front and rear frame members 262, 264 may be collapsed flat onto pallet 150 irrespective of the sequence in which frame members 262, 264 are folded inward. The vertical oblong channel portions of guide tracks 282 permit the base of the subsequently folded front or rear frame member 262 or 264 to be raised upward while tracking pins remain engaged in the vertical oblong channel portions of guide tracks 282, thereby placing the base of the raised frame member 262 or 264 above the body of the previously folded frame member 262 or 264. The raised frame member 262 or 264 is permitted to fold down into a horizontal orientation on top of the other frame member 262 or 264 which had been previously folded inward onto pallet 150. In this manner, both frame members 262, 264 are arranged in a compact horizontal position to minimize the storage area consumed by the collapsed container.

FIGS. 31 and 32 show steps for folding side frame members 266, 268. Folding of side frame members 266, 268 onto front and rear frame members 262, 264 is sequence independent. Opposite edges of each of side frame members 266, 268 have tracking pins (not shown) protruding outwardly into vertical oblong guide tracks 289. Either of side frame members 266 or 268 may be folded inward prior to the other, coming to rest on the previously folded side frame member 262 or 264. The remaining side frame member 266 or 268 is raised upward as its outwardly protruding track pins move upward along guide tracks 289, thereby allowing the remaining side frame member 266 or 268 to be folded inward to a flat, horizontal position on the previously folded frame member 266 or 268.

Figure 34:
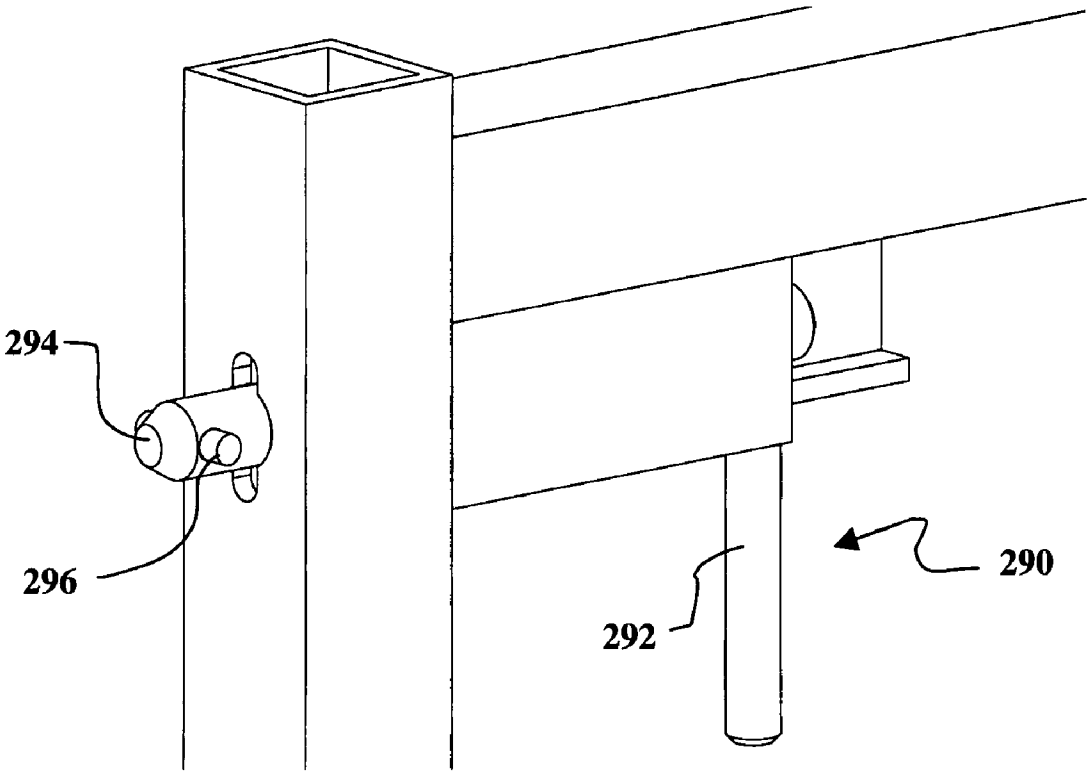
FIG. 34 is a perspective view of a latching mechanism of the collapsible rack system of FIGS. 25 and 26.

An exemplary latch 290 is shown in FIG. 34. Latch 290 includes a handle 292 fixedly connected to a locking pin 294. A torsion spring or compression spring (not shown) urges handle 292 into a locked position shown in FIG. 34. Latch 290 may be grasped and operated to pivot outward away from the face of front frame member 262 to rotate locking pin 294 about ninety degrees. Radially protruding arms 296 of locking pin 294 are thereby disengaged and may be retracted from a counterpart receptacle (not shown) of side wall 266, 268. It should be understood that various latching mechanisms may be substituted for or used in combination with latch 290.

It should be understood that pallet 50 of the first embodiment of the invention may be substituted for automatically locking pallet 150 in relation to the collapsible container of FIGS. 13-21 and the collapsible rack system of FIGS. 22-34. Similarly, pallet 150 may be substituted into the rack and container systems of FIGS. 4 and 5.

An advantage of the above-described and illustrated embodiments is the capability of converting between container structure 210 and rack system 260 while retaining pallets 50, 150 as a common support base. Pallets 50, 150 do not require any modification, other than the substitution of panels 212, 214, 216, 218 for frame members 262, 264, 266, 268, and vice versa.

Figure 35:
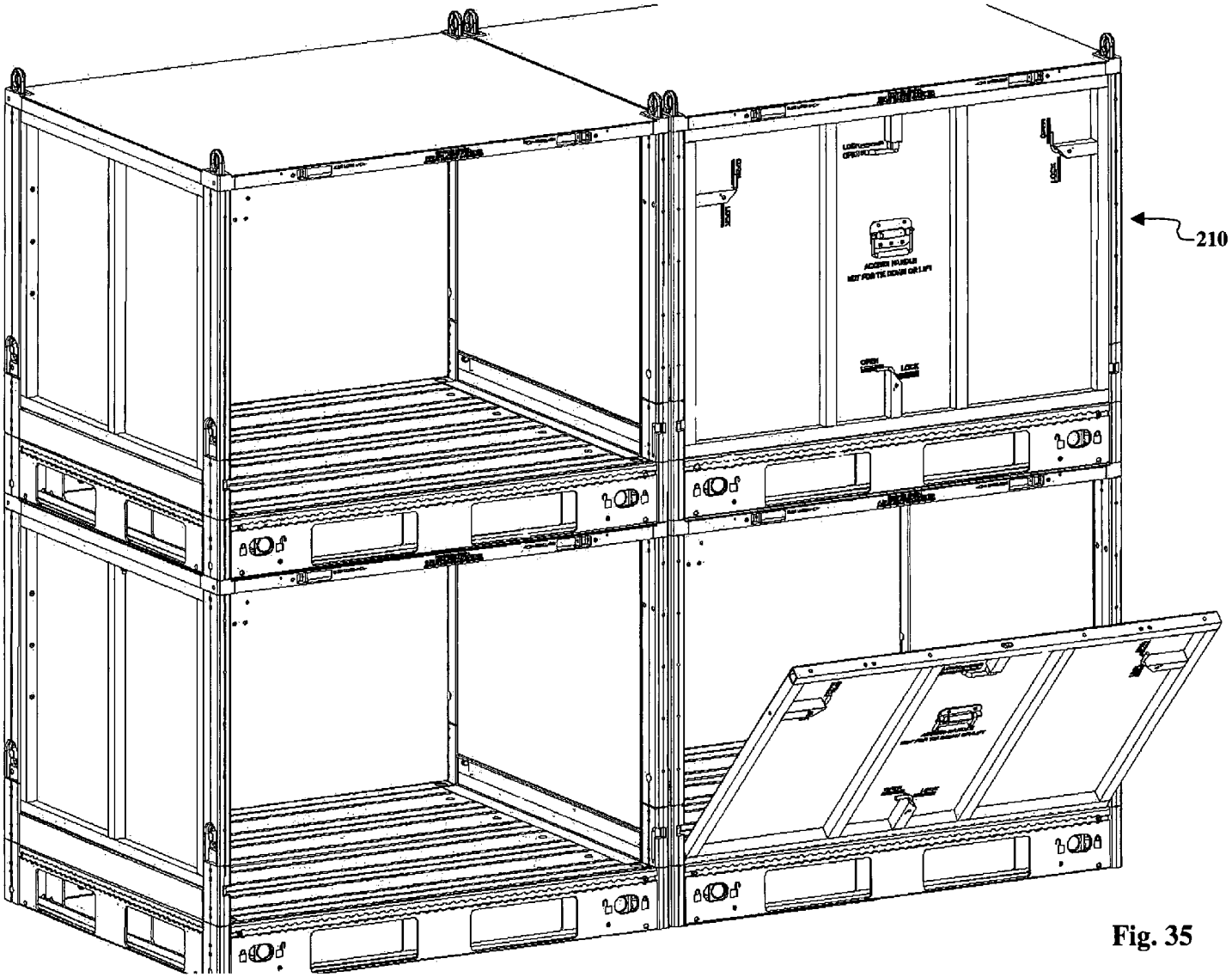
FIGS. 35-39 are perspective views of examples of modular storage and shipping systems according to additional embodiments of the invention.

Another advantage of the above-described and illustrated embodiments is the modularity of storage assemblies, i.e., container 210 and rack system 260. As shown in FIG. 35, containers 210 are stackable on and interlockable with one another. FIG. 35 shows a lower first container including a first pallet, structural support members (e.g., panels) extending above the first pallet, and interface fittings on the structural support members. A substantially identical, upper second container rests on the first container. The second container includes a second pallet with locking components (e.g., locking bolts 72, 172) selectively engaged with the interface fittings of the first container. In the event pallet 50 is used as the upper, second pallet, locking bolts 72 are operatively connected to one another to permit concomitant movement of locking bolts 72 into and out of engagement with the interface fittings of the first container for selectively interlocking the first and second containers to one another. In the event that automatically locking pallet 150 is used as the upper, second pallet, insertion of forklift tines through the forklift tine openings of pallet 150 activates actuators 194, 202, causing the operatively connected locking bolts 172 to move out of locking arrangement with the interface fittings of the lower first container so that the upper container may be lifted away from the lower container. It should be understood that three or more containers may be stacked on one another.

Figure 36:
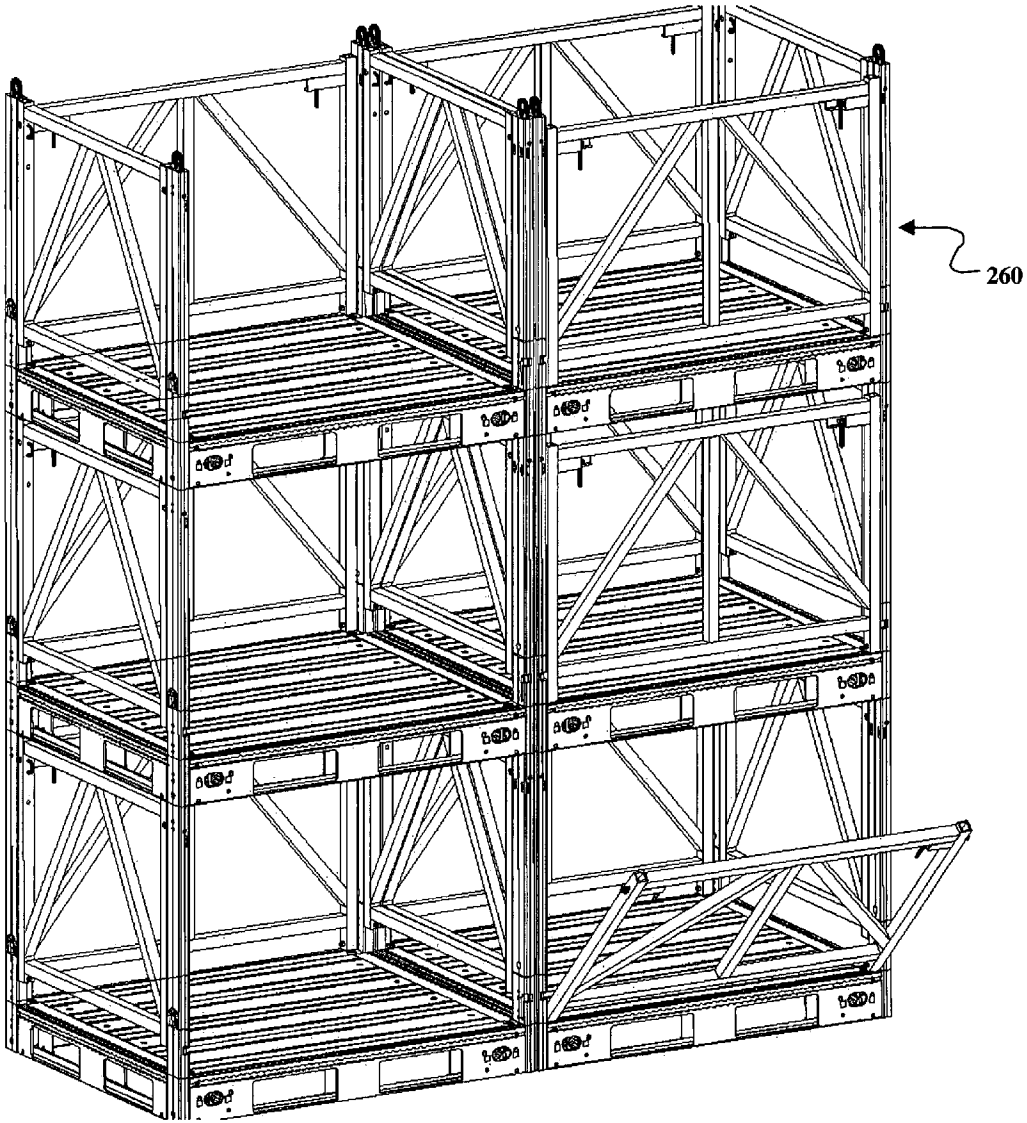

FIG. 36 illustrates racks 260 stackable on and interlockable with one another. A lower first rack comprises a first pallet, structural support members (e.g., frame members) extending above the first pallet, and interface fittings on the structural support members. A substantially identical, middle second rack rests on the first rack. The second rack includes a second pallet with locking components (e.g., locking bolts 72, 172) selectively engaged with the interface fittings of the first rack. In the event pallet 50 is used as the upper, second pallet, locking bolts 72 are operatively connected to one another to permit concomitant movement of locking bolts 72 into and out of engagement with the interface fittings of the first rack for selectively interlocking the first and second racks to one another. In the event that automatically locking pallet 150 is used as the upper, second pallet, insertion of forklift tines through the forklift tine openings of pallet 150 activates actuators 194, 202, causing the operatively connected locking bolts 172 to move out of locking arrangement with the interface fittings of the lower first rack. It should be understood that two, four, or more racks may be stacked on one another.

Figure 37:
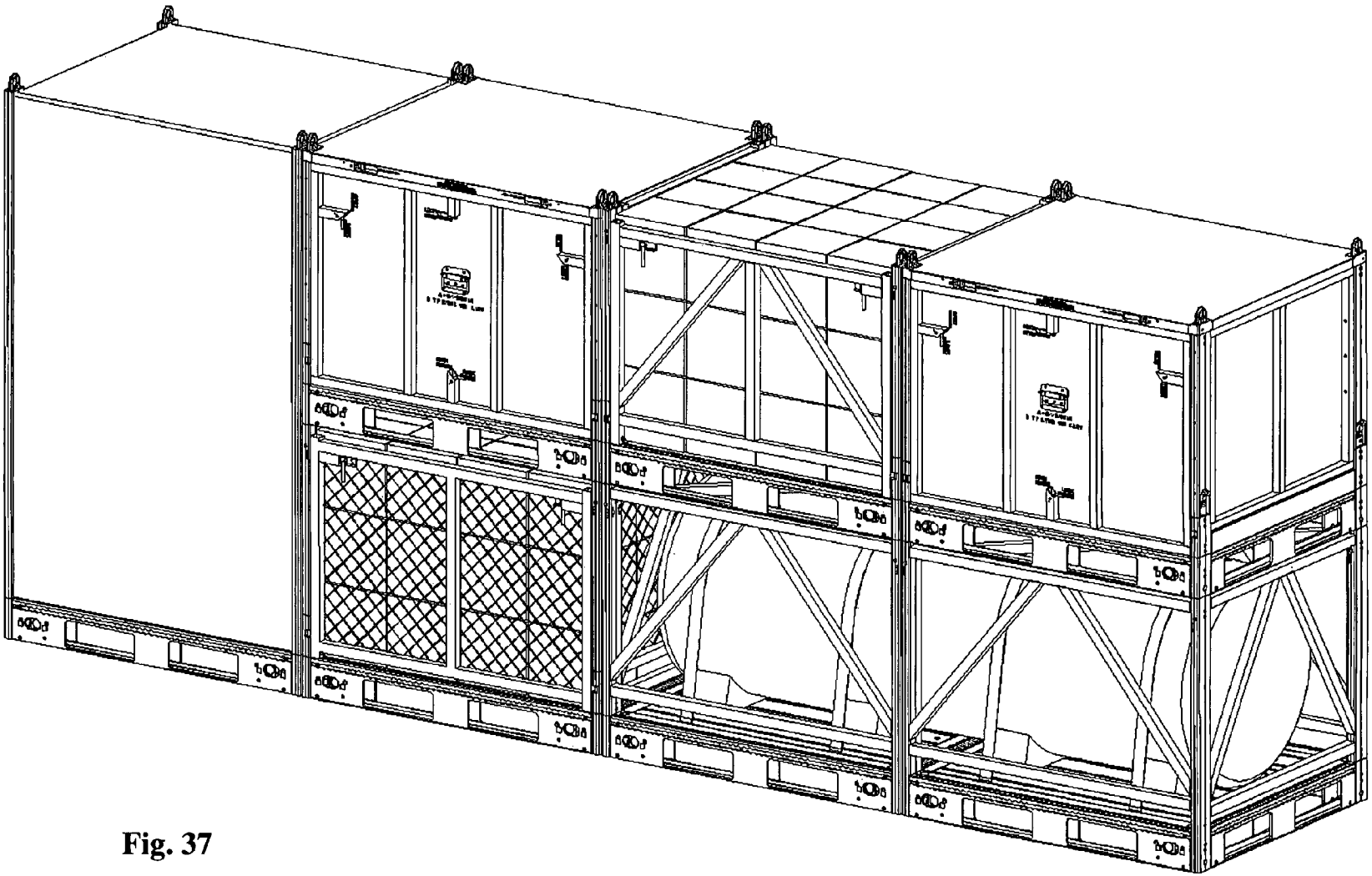

FIG. 37 represents further examples of the modularity of the shipping and storage system. As shown in FIG. 37, containers 210 may be stacked on and interlocked with racks 260, and vice versa. Further, containers and racks included within the system may possess different sizes. For example, the container on the far left of FIG. 37 is twice the height of the other containers and racks to its right.

Figure 38:
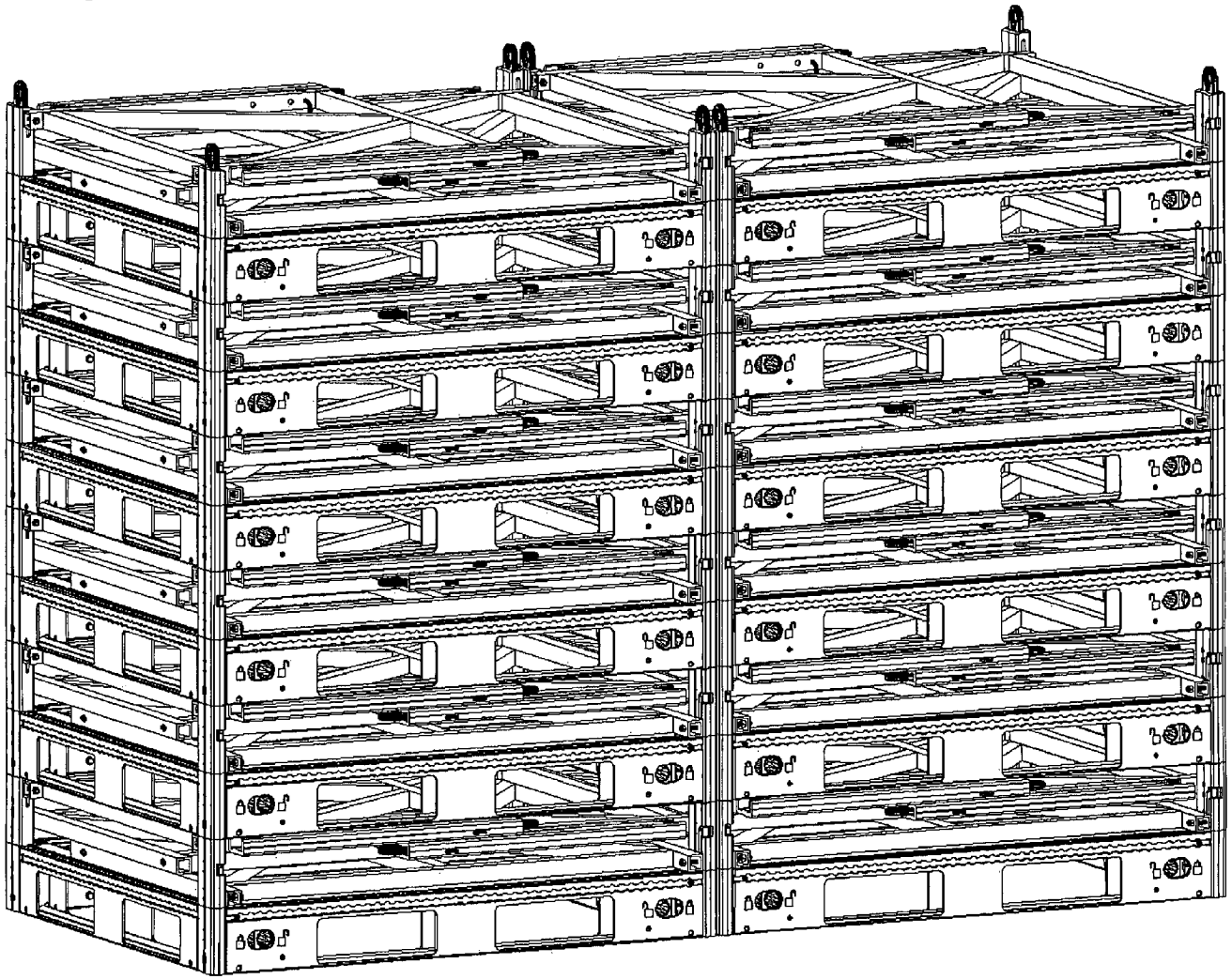

As yet another advantage, collapsible containers 210 and collapsible racks 260 may be stacked and interconnected to one another while in their collapsed state, as shown in FIG. 38. Skirt interface fittings 226, 276 are received in corner posts 58, 158 and engaged by locking mechanisms of pallet 50, 150 stacked thereon.

Figure 39:
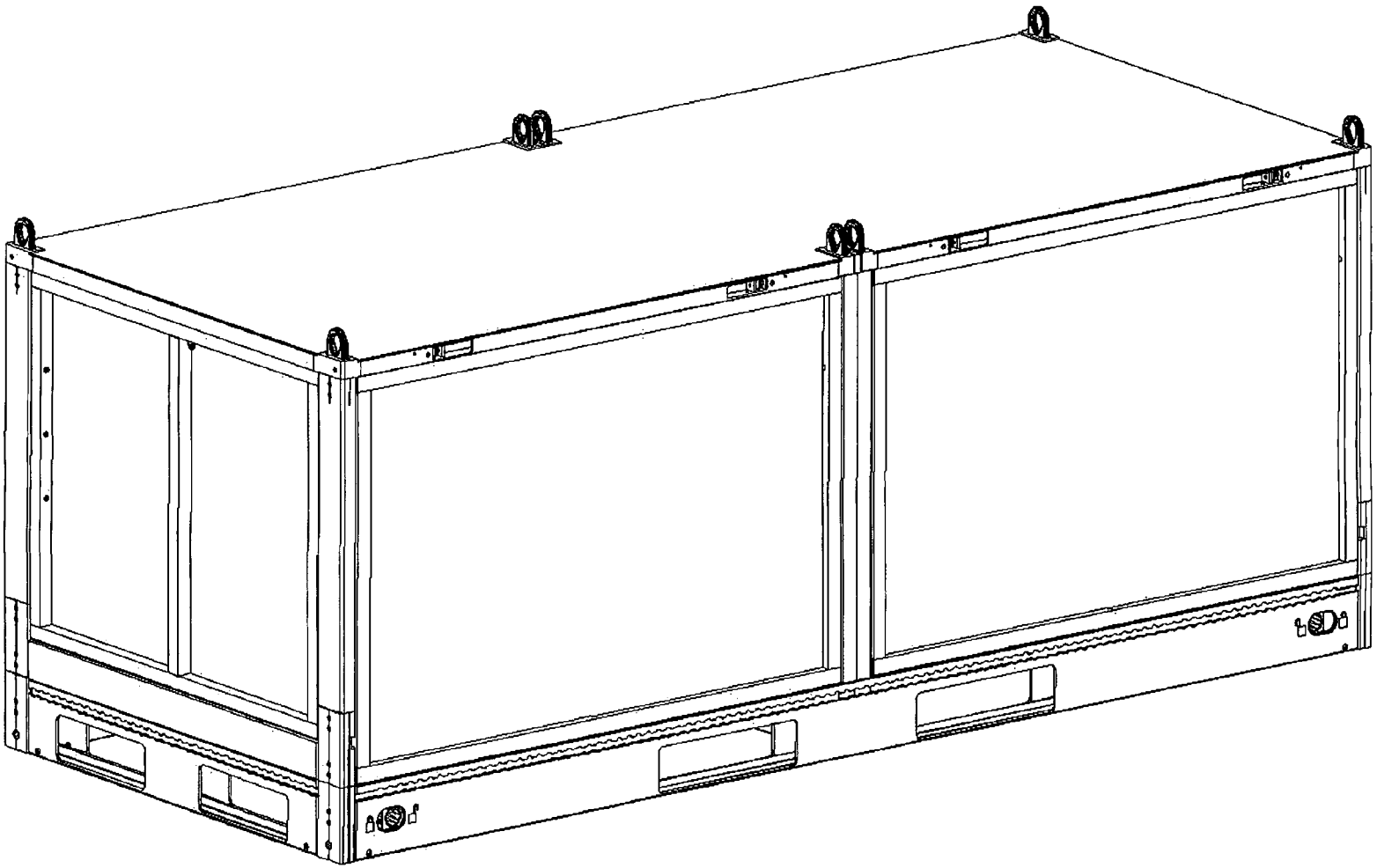

FIG. 39 illustrates that the dimensions of the pallet or structural support members may be adjusted to fit multiple containers or rack systems on a single pallet. Additional pallets and storage assemblies are stackable thereon. As shown in FIG. 40, the interface fittings of the storage and shipping containers, racks, and pallets described above also may function as grasping elements for a top lifting frame 300.

Additional advantages and modifications will readily occur to those skilled in the art. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A plurality of stackable, inter-lockable storage assemblies, comprising:

a first storage assembly comprising a first pallet, first and second structural support members extending above the first pallet, and first and second interface fittings on the first and second structural support members, respectively; and a second storage assembly comprising a second pallet, first and second locking components operatively connected to one another, and an actuator for moving concomitantly the first and second locking components into and out of engagement with the first and second interface fittings, respectively, for selectively interlocking the first storage assembly and the second storage assembly to one another.

2. The inter-lockable storage assemblies of claim 1, wherein the second storage assembly is stackable on the first storage assembly, and wherein the second pallet comprises first and second openings for receiving from below the first and second interface fittings, respectively.

3. The inter-lockable storage assemblies of claim 1, wherein the first storage assembly further comprises third and fourth interface fittings, said first, second, third and fourth interface fittings each located at a respective corner of the first storage assembly, and wherein the second pallet comprises first and second openings for receiving from below the third and fourth interface fittings, respectively.

4. The inter-lockable storage assemblies of claim 1, wherein the first storage assembly further comprises third and fourth interface fittings, and wherein the second pallet further comprises third and fourth locking components operatively connected to one another to permit concomitant movement of the third and fourth locking components into and out of engagement with the third and fourth interface fittings, respectively.

5. The inter-lockable storage assemblies of claim 4, wherein the first, second, third, and fourth locking components are operatively connected to one another to permit concomitant movement into and out of engagement with the first, second, third, and fourth interface fittings, respectively.

6. The inter-lockable storage assemblies of claim 1, wherein the first and second interface fittings comprise a first eyelet and a second eyelet, respectively, and wherein the first and second locking components comprise a first locking bolt and a second locking bolt, respectively, movable into and out of engagement with the first eyelet and the second eyelet, respectively.

7. The inter-lockable storage assemblies of claim 6, further comprising a first pivot joint for moving the first locking bolt into and out of engagement with the first eyelet;

a second pivot joint for moving the second locking bolt into and out of engagement with the second eyelet; and a shaft operatively connecting to the first pivot joint and the second pivot joint for moving the first locking bolt and the second locking bolt in unison.

8. The inter-lockable storage assemblies of claim 1, wherein the first and second structural members of the first storage assembly comprise a first plurality of walls supported by the first pallet to define a first container, which includes a first compartment.

9. The inter-lockable storage assemblies of claim 8, wherein the second storage assembly is a second container, and wherein the second container is comprised of a second plurality of walls supported by the second pallet to establish a second compartment.

10. The inter-lockable storage assemblies of claim 1, wherein the first and second structural members comprise a first plurality of frame members supported by the first pallet to define a first rack system, which includes a first open storage area.

11. The inter-lockable storage assemblies of claim 10, wherein the second storage assembly is a second rack system, and wherein the second rack system comprises a second plurality of frame members supported by the second pallet to establish a second rack system, which includes the second open storage area.

12. The inter-lockable storage assemblies of claim 1, wherein one of the first storage assembly and the second storage assembly comprises a container including a plurality of walls and a compartment, and wherein an other of the first storage assembly and the second storage assembly comprises a rack system, the rack system comprises a plurality of frame members and an open storage area.

13. The inter-lockable storage assemblies of claim 1, wherein the structural support members are selected from frame members and walls, and wherein the first and second structural support members are movable from an upright position to a collapsed position in which the first and second structural support members lie substantially flat on the first pallet while remaining connected to the first pallet.

* * * * *